US008640666B2

(12) United States Patent
Kameda et al.

(10) Patent No.: US 8,640,666 B2
(45) Date of Patent: Feb. 4, 2014

(54) SPARK PLUG FOR INTERNAL COMBUSTION ENGINE

(75) Inventors: Hiroyuki Kameda, Aichi (JP); Katsutoshi Nakayama, Nagoya (JP); Kaori Kishimoto, Nagoya (JP); Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 894 days.

(21) Appl. No.: 12/810,652

(22) PCT Filed: Dec. 25, 2008

(86) PCT No.: PCT/JP2008/073559
§ 371 (c)(1),
(2), (4) Date: Jun. 25, 2010

(87) PCT Pub. No.: WO2009/084575
PCT Pub. Date: Jul. 9, 2009

(65) Prior Publication Data

US 2010/0275870 A1 Nov. 4, 2010

(30) Foreign Application Priority Data

Dec. 28, 2007 (JP) ..... 2007-338712
Jun. 9, 2008 (JP) ..... 2008-150201

(51) Int. Cl.
*H01T 13/20* (2006.01)
*H01T 13/39* (2006.01)

(52) U.S. Cl.
USPC ..... 123/169 EL; 313/141

(58) Field of Classification Search
USPC ..... 123/169 EL; 313/141, 144
See application file for complete search history.

(56) References Cited

U.S. PATENT DOCUMENTS 4,700,103 A 10/1987 Yamaguchi et al.
4,970,426 A * 11/1990 Bronchart ..... 313/141
(Continued)

FOREIGN PATENT DOCUMENTS

EP 1143587 A2 10/2001
JP 5940482 A 3/1984
(Continued)

OTHER PUBLICATIONS

Communication dated Dec. 6, 2011 from the Japanese Patent Office in counterpart Japanese application No. 2008-329547.
(Continued)

*Primary Examiner* — Thomas Moulis
(74) *Attorney, Agent, or Firm* — Sughrue Mion, PLLC

(57) ABSTRACT

A spark plug includes a center electrode extending along an axial line, a ground electrode, and a noble metal tip. A center axis of the noble metal tip is displaced from a center axis of the ground electrode toward a base-end side in the axial line. The ground electrode includes an outer layer and an inner layer, and a distal end of the inner layer is closer to the axial line than a base end of the ground electrode. An overlap area between the inner layer and the noble metal tip occupies a ratio of 25% or more in a projective plane defined by projecting, along the center axis, a plane of the ground electrode viewed from a distal-end face on a cross section of the ground electrode in which a maximum cross-sectional area of the inner layer is achieved, among cross sections orthogonal to the center axis.

15 Claims, 11 Drawing Sheets

(56) References Cited

U.S. PATENT DOCUMENTS

| | | | | |
|---|---|---|---|---|
| 5,461,276 | A * | 10/1995 | Matsutani et al. | 313/141 |
| 5,488,262 | A | 1/1996 | Takamura | |
| 5,574,329 | A | 11/1996 | Kagawa | |
| 5,811,915 | A | 9/1998 | Abe et al. | |
| 5,866,973 | A * | 2/1999 | Kagawa et al. | 313/141 |
| 6,523,515 | B2 * | 2/2003 | Kanao | 123/169 EL |
| 6,707,237 | B2 | 3/2004 | Teramura et al. | |
| 6,720,716 | B2 | 4/2004 | Shibata et al. | |
| 6,724,132 | B2 | 4/2004 | Kanao | |
| 6,798,124 | B2 | 9/2004 | Hiramatsu | |
| 7,084,558 | B2 | 8/2006 | Teramura et al. | |
| 7,154,213 | B2 | 12/2006 | Nakamura et al. | |
| 7,224,109 | B2 | 5/2007 | Kanao | |
| 7,321,187 | B2 | 1/2008 | Teramura et al. | |
| 7,808,165 | B2 | 10/2010 | Kowalski | |
| 8,013,504 | B2 * | 9/2011 | Kameda et al. | 313/141 |
| 8,102,105 | B2 * | 1/2012 | Ban et al. | 313/141 |
| 8,288,929 | B2 * | 10/2012 | Nunome et al. | 313/141 |
| 2001/0025617 | A1 | 10/2001 | Kanao | |
| 2002/0021066 | A1 | 2/2002 | Kanao | |
| 2002/0093277 | A1 | 7/2002 | Hiramatsu | |
| 2002/0105254 | A1 | 8/2002 | Hori et al. | |
| 2004/0041506 | A1 | 3/2004 | Teramura et al. | |
| 2005/0062385 | A1 | 3/2005 | Nakamura et al. | |
| 2005/0168121 | A1 * | 8/2005 | Tinwell | 313/141 |
| 2005/0218771 | A1 | 10/2005 | Hrastnik et al. | |
| 2005/0264152 | A1 | 12/2005 | Kanao | |
| 2006/0238092 | A1 | 10/2006 | Teramura et al. | |
| 2006/0276097 | A1 | 12/2006 | Suzuki et al. | |
| 2007/0216275 | A1 * | 9/2007 | Torii et al. | 313/141 |
| 2007/0290593 | A1 | 12/2007 | Kowalski | |
| 2008/0174221 | A1 | 7/2008 | Tinwell | |
| 2012/0062099 | A1 * | 3/2012 | Miyashita et al. | 313/144 |
| 2012/0293061 | A1 * | 11/2012 | Tanaka et al. | 313/141 |

FOREIGN PATENT DOCUMENTS

| | | | |
|---|---|---|---|
| JP | 61-45583 | A | 3/1986 |
| JP | 5-101869 | A | 4/1993 |
| JP | 5-166577 | A | 7/1993 |
| JP | 5-198348 | A | 8/1993 |
| JP | 5242952 | A | 9/1993 |
| JP | 722157 | A | 1/1995 |
| JP | 11-185928 | A | 7/1999 |
| JP | 2001-351761 | A | 12/2001 |
| JP | 2002-83662 | A | 3/2002 |
| JP | 3273215 | B2 | 4/2002 |
| JP | 2002-289321 | A | 10/2002 |
| JP | 2002-324650 | A | 11/2002 |
| JP | 200479507 | A | 3/2004 |
| JP | 2004-127916 | A | 4/2004 |
| JP | 2004-259710 | A | 9/2004 |
| JP | 2005-100747 | A | 4/2005 |
| JP | 2005-294267 | A | 10/2005 |
| JP | 2005339864 | A | 12/2005 |
| WO | WO 2007149862 | A2 | 12/2007 |

OTHER PUBLICATIONS

European Search Report dated Dec. 11, 2012 issued by the European Patent Office in counterpart European Application No. 08866011.3.

* cited by examiner

SPARK PLUG FOR INTERNAL COMBUSTION ENGINE

TECHNICAL FIELD

The present invention relates to a spark plug used in an internal combustion engine.

BACKGROUND ART

A spark plug for use in an internal combustion engine, such as an automobile engine, includes, for example, a center electrode extending in an axial direction, an insulator provided outside the center electrode, a cylindrical metal shell provided outside the insulator, and a ground electrode having a base end joined to a leading end of the metal shell. The ground electrode is arranged in a bent manner such that a distal end of an inner periphery thereof opposes the leading end of the center electrode, whereby a spark discharge gap is formed between the leading end of the center electrode and the distal end of the ground electrode. In addition, there is proposed a technique for enhancing spark wear resistance by joining a tip (a noble metal tip) made of a noble metal alloy to the leading end of the center electrode and the distal end of the ground electrode, respectively (see Patent Document 1, for example).

From the viewpoint of fulfillment of superior performance for a heat radiation of the ground electrode, there is a known technique providing the ground electrode having a two-layer structure including an outer layer made of a Ni alloy and an inner layer made of a copper alloy that is metal superior to the Ni alloy in terms of heat conduction, and the like.

Patent Document 1: JP-A-5-242952

DISCLOSURE OF THE INVENTION

Problem To Be Solved By the Invention

Incidentally, a further increase in internal temperature of a combustion chamber has recently been demanded from the viewpoint of enhancement of combustion efficiency, and the like. When a noble metal tip is provided on the ground electrode, heat of the noble metal tip is conducted by way of the ground electrode. When the internal temperature of the combustion chamber is increased as mentioned above, heat conduction of the noble metal tip by way of the ground electrode may become insufficient. If heat conduction of the noble metal tip becomes insufficient, a temperature difference between the noble metal tip and the ground electrode will increase; hence, stress acting on a welded portion between the noble metal tip and the ground electrode will become great, which will in turn arouse a concern about a decrease in separation resistance of the noble metal tip. In addition, there is the potential for a drop in durability of the noble metal tip and insufficient achievement of an effect of enhancement of spark wear resistance, which would otherwise be induced as a result of provision of the noble metal tip.

The present invention was made in consideration of the above circumstance, and an object thereof is to provide a spark plug for use in an internal combustion engine that enables enhancement of performance for heat conduction of a noble metal tip and, by extension, enhancement of separation resistance and durability of the noble metal tip by optimizing a positional relationship between an inner layer of a ground electrode and the noble metal tip.

Means For Solving the Problem

Configurations suitable for accomplishing the objective are hereinbelow described below as respective items. An effect peculiar to a corresponding configuration is additionally provided, as necessary.

Configuration 1: A spark plug for an internal combustion engine comprises: a rod-shaped center electrode extending in an axial direction; a substantially-cylindrical insulator that has an axial hole extending in the axial direction and in which the center electrode is provided in the axial hole; a substantially-cylindrical metal shell provided around an outer periphery of the insulator; a ground electrode that extends from a leading end portion of the metal shell and whose distal end is bent toward the center electrode; and a noble metal tip joined to a distal end portion of the ground electrode, wherein: a gap is formed between the leading end portion of the center electrode and the noble metal tip; the noble metal tip is joined such that a center axis of the noble metal tip is displaced from a center axis of the ground electrode toward a base-end side in the axial direction; the ground electrode comprises an outer layer made of a nickel alloy and an inner layer made of a material that exhibits thermal conductivity superior to that of the outer layer; a distal end of the inner layer is situated closer to the axial line than a base end of the ground electrode; and an overlap area between the inner layer and the noble metal tip occupies a ratio of 25% or more in a projective plane, the projective plane being defined by projecting, along the center axis of the ground electrode, a plane of the ground electrode viewed from a distal-end face side of the ground electrode on a cross section of the ground electrode in which a maximum cross-sectional area of the inner layer is achieved among cross sections orthogonal to the center axis of the ground electrode.

A noble metal portion made of a noble metal alloy can also be provided on a leading end portion of the center electrode. In this case, the gap is formed between the noble metal portion provided on the center electrode and the noble metal tip provided on the ground electrode.

According to Configuration 1, the ground electrode has a double-layer structure including an outer layer and an inner layer that contains a material exhibiting thermal conductivity superior to that of the outer layer, and the inner layer extends toward the axial line with respect to the base end of the ground electrode (the inner layer extends in excess of a straight line, which is an extension of the inner periphery of the metal shell toward the leading-end side along the axial line, within a cross section through which the center axis of the ground electrode and the axial line pass). Specifically, since the inner layer exhibiting superior thermal conductivity is provided up to a position comparatively close to the noble metal tip, heat of the noble metal tip can be conducted by way of the inner layer, which in turn enables enhancement of performance for conducting heat of the noble metal tip.

Further, the noble metal tip, which is to be located at the center of the combustion chamber and subjected to a larger quantity of heat, is joined to the ground electrode such that a center axis of the noble metal tip is displaced toward the base-end side in the axial line (toward the metal shell) than the center axis of the ground electrode. That is, the noble metal tip is disposed at a position spaced from the center of the combustion chamber. Therefore, the quantity of heat to which the noble metal tip is subjected during combustion can be comparatively reduced, so that a drop in separation resistance and durability can be more reliably prevented.

Moreover, according to Configuration 1, the noble metal tip is provided such that an overlap area within a projective plane between the inner layer and the noble metal tip comes to 25% or more of the area of the inner layer within the projective plane where the projective plane is defined by projecting, along the center axis of the ground electrode, a plane of the ground electrode viewed from a distal-end face side of the ground electrode on a cross section of the ground electrode in which a maximum cross-sectional area of the inner layer is achieved among cross sections orthogonal to the center axis of the ground electrode. In short, an overlap area between the inner layer and the noble metal tip achieved along the center axis of the ground electrode is made comparatively large. As a result, heat of the noble metal tip can be efficiently conducted toward the metal shell by way of the inner layer exhibiting superior thermal conductivity, so that the performance for conducting heat of the noble metal tip can be more enhanced. As a consequence, the greater betterment of separation resistance and durability can be sought.

As mentioned above, combined actions of effects yielded by the respective portions are accomplished as a result of adoption of Configuration 1. Separation resistance and durability of the noble metal tip can be improved by leaps and bounds by means of the combined actions.

Further, since tremendous betterment of separation resistance and durability of the noble metal tip can be sought, effects obtained by provision of the noble metal tip; namely, betterment of spark wear resistance are more reliably, effectively yielded.

Configuration 2: In the spark plug for use in an internal combustion engine of the present configuration, in Configuration 1, the overlap area between the inner layer and the noble metal tip occupies a ratio of 28% or more in the projective plane.

According to Configuration 2, separation resistance and durability of the noble metal tip can further be enhanced. From the viewpoint of further enhancement of separation resistance and durability, it is preferable to increase the overlap ratio between the inner layer and the noble metal tip along the center axis of the ground electrode. Therefore, it is preferable to set the overlap ratio to 30% or more.

Configuration 3: In the spark plug for use in an internal combustion engine of the present configuration, in Configuration 1 or 2, the noble metal tip is joined such that the center axis of the noble metal tip is displaced 0.1 mm or more from the center axis of the ground electrode toward the base-end side in the axial direction.

According to Configuration 3, the noble metal tip is arranged at a position further spaced apart from the center of the combustion chamber. Therefore, a further reduction in the amount of heat to which the noble metal tip is subjected can be sought, and further betterment of durability can be sought.

Configuration 4: In the spark plug for use in an internal combustion engine of the present configuration, in any one of Configurations 1 to 3, a shortest distance between the inner layer and the noble metal tip is set so as to range from 0.5 mm to 2 mm.

According to Configuration 4, the distance between the inner layer and the noble metal tip is set to 2 mm or less. Therefore, the inner layer exhibiting superior thermal conductivity can conduct heat of the noble metal tip more efficiently.

In the meantime, when the distance between the inner layer and the noble metal tip is set to a value of less than 0.5 mm, heat of the noble metal tip is excessively conducted, which may induce a temperature difference between the noble metal tip and the ground electrode and an increase in stress acting on the joined portion between the noble metal tip and the ground electrode. In this regard, according to Configuration 4, the shortest distance between the inner layer and the noble metal tip is set to 0.5 mm or more. Therefore, the temperature difference between the noble metal tip and the ground electrode can be made comparatively small, and stress acting on the joined portion between the noble metal tip and the ground electrode can be made comparatively small.

From above, it is possible to sufficiently conduct heat of the noble metal tip to such an extent that heat is not excessively conducted, by setting the distance between the inner layer and the noble metal tip so as to range from 0.5 mm to 2 mm, whereby further betterment of separation resistance can be sought.

Configuration 5: In the spark plug for use in an internal combustion engine of the present configuration, in any one of Configurations 1 to 4, the noble metal tip is joined to an inner periphery of the ground electrode situated close to a center electrode side while a distal-end face of the noble metal tip protrudes from a distal-end face of the ground electrode.

According to Configuration 5, since the noble metal tip can be arranged at a position further spaced apart from the center of the combustion chamber, further enhancement of separation resistance and durability can be sought.

Configuration 6: In the spark plug for use in an internal combustion engine of the present configuration, in Configuration 5, a length of a portion of the noble metal tip joined to the ground electrode along the center axis of the ground electrode is set so as to range from 0.5 mm to 1.5 mm.

When the joined portion between the ground electrode and the noble metal tip is too large (too long), it becomes difficult to uniformly weld respective joined portions, which in turn makes it easy to cause irregularities in welding. If welding irregularities arise, a difference will occur in thermal stress developing in the joined portions, which makes the noble metal tip easier to peel off. In the meantime, when the joined portion between the ground electrode and the noble metal tip is too small (too short), it is impossible to assure sufficient joining strength, which will arouse a concern about a drop in separation resistance.

In this regard, according to Configuration 6, the length of the portion of the noble metal tip joined to the ground electrode along the center axis of the ground electrode is set so as to range from 0.5 mm to 1.5 mm. Accordingly, the possibility of occurrence of welding irregularities can be minimized, and sufficient welding strength can be assured. As a consequence, further betterment of separation resistance can be sought.

Configuration 7: In the spark plug for use in an internal combustion engine of the present configuration, in Configuration 5 or 6, a depth to which the noble metal tip is embedded from the internal periphery of the ground electrode is set to 0.1 mm or more.

According to Configuration 7, since the noble metal tip is joined to the ground electrode while being embedded to a sufficient depth, the strength of join between the noble metal tip and the ground electrode can be enhanced, which in turn improves separation resistance to a much greater extent.

Configuration 8: In the spark plug for use in an internal combustion engine of the present configuration, in any one of Configurations 1 to 7, in that a portion of the ground electrode, which is joined to the noble metal tip, is flat.

According to Configuration 8, since the portion of the ground electrode to which the noble metal tip is to be joined is made flat, the noble metal tip can be joined to the ground electrode in a comparatively, easy, stable manner. As a result, the strength of adhesion between the noble metal tip and the ground electrode can further be improved, and further betterment of separation resistance of the noble metal tip can be sought.

Configuration 8 is significant for a case where the ground electrode formed to have a circular cross-sectional profile, and the like, is used in order to enhance ignitability by making it easier for a mixed air to flow into the spark discharge gap.

Configuration 9: In the spark plug for use in an internal combustion engine of the present configuration, in Configuration 8, the inner periphery of the ground electrode is subjected to cutting or pressing so as to make flat the portion to which the noble metal tip is to be joined.

According to Configuration 9, the portion of the ground electrode to which the noble metal tip is to be joined can be made flat in a comparatively-easy manner. Moreover, the portion is subjected to cutting, pressing, and the like, whereby the inner periphery of the ground electrode is recessed toward an outer periphery. The overlap ratio between the inner layer and the noble metal tip along the center axis of the ground electrode can be increased comparatively easily, by joining the noble metal tip to the recess. Specifically, Configuration 1 can be embodied comparatively readily, and separation resistance and durability can be enhanced comparatively readily and more reliably.

Configuration 10: In the spark plug for use in an internal combustion engine of the present configuration, in any one of Configurations 1 to 9, the distal-end face of the noble metal tip is arranged so as to oppose the leading end portion of the center electrode; and spark discharge is produced substantially along a direction orthogonal to the axial direction.

The aforementioned technical idea about the each configuration may be embodied in the form of a spark plug that produces spark in a so-called lateral direction as in Configuration 10. In this case, the extent to which the ground electrode protrudes toward the center of the combustion chamber can be made comparatively small. Hence, quantities of heat to which the ground electrode and the noble metal tip are subjected can further be reduced, so that separation resistance and durability can be enhanced to a much greater extent.

Configuration 11: In the spark plug for use in an internal combustion engine of the present configuration, in any one of Configurations 1 to 9, an end face of the noble metal tip in the axial direction is arranged so as to oppose the leading end portion of the center electrode; and spark discharge is produced substantially along the axial direction.

The aforementioned technical idea about each configuration may be embodied in the form of a spark plug that produces spark in a so-called longitudinal direction as in Configuration 11. In this case, the spark discharge gap is situated at a position closer to the center of the combustion chamber, so that superior ignitability can be realized.

Configuration 12: In the spark plug for use in an internal combustion engine of the present configuration, the end face of the noble metal tip is arranged to oppose the axial line situated on the leading-end side than the center electrode; and spark discharge is produced obliquely with respect to the axial direction.

The aforementioned technical idea about each configuration may be embodied in the form of a spark plug that produces spark in a so-called diagonal direction as in Configuration 12. In this case, the extent to which the ground electrode protrudes can be made comparatively small. Hence, a quantity of heat to which the ground electrode, or the like, is subjected can be reduced, so that further betterment of separation resistance, and the like, can be sought. Moreover, in the case of a spark plug of a type that produces spark in a longitudinal direction, there is a concern that the ground electrode may hinder propagation of flame toward the center of the combustion chamber. However, Configuration 12 enables erasure of the concern, and enhancement of flame propagation can be sought. Separation resistance and flame propagation can be enhanced in a well-balanced manner by adoption of the type of the spark plug that produces spark in a diagonal direction.

Configuration 13: In the spark plug for use in an internal combustion engine of the present configuration, in any one of Configurations 1 to 12, the maximum cross-sectional area of the ground electrode achieved within a cross section orthogonal to the center axis of the ground electrode is set to 3.3 $mm^2$ or less.

In response to a request for a decrease in the diameter of a spark plug (e.g., an outer diameter of a thread is M12 or less), the portion of the leading-end face of the metal shell to which the ground electrode is to be joined is usually made smaller. Further, in order to cope with such a metal shell having a comparatively-smaller leading-end face, a smaller ground electrode (having a smaller cross section) can be adopted. In addition, from the viewpoint of facilitation of inflow of a mixed air into a spark discharge gap, a cross-sectional area of the ground electrode is likely to become comparatively smaller when the ground electrode is formed to have a circular cross-sectional profile, and the like, as mentioned above. When the cross-sectional area of the ground electrode is made comparatively small, performance for conducting heat from the noble metal tip that is performed by way of the ground electrode is likely to become insufficient. Specifically, in relation to the ground electrode having a comparatively-small cross-sectional area, there is an additional concern about a reduction in the separation resistance and durability of the noble metal tip.

In this regard, the ground electrode described in connection with Configuration 13 has 3.3 $mm^2$ or less of a comparatively-small maximum cross-sectional area, which arouses a concern about a decrease in separation resistance and durability. However, sufficient performance for conducting heat from the noble metal tip can be fulfilled by adoption of Configuration 1, or the like. In other words, when the cross-sectional area of the ground electrode is comparatively small, adoption of Configuration 1, and the like, can be said to be significant.

In particular, when the cross-sectional area of the ground electrode is small (when the cross-sectional area is 3.3 $mm^2$ or less), an effect obtained by setting a ratio (an overlap ratio) at which the overlap between the inner layer and the noble metal tip within the projective plane occupies the inner layer in the projective plane to 25% or more are yielded more effectively. More specifically, in light of a rate of improvement in heat conduction performance achieved when the overlap ratio is comparatively large (25% or more) with reference to heat conduction performance achieved when the overlap ratio is comparatively small (less than 25%), as the cross-sectional area of the ground electrode becomes smaller, the rate of improvement in heat conduction performance can further be increased. Specifically, increasing the overlap ratio to 25% or more can be said to be particularly significant when the cross-sectional area of the ground electrode is comparatively small.

Configuration 14: In the spark plug for use in an internal combustion engine of the present configuration, in any one of Configurations 1 to 13, a relationship of $0.35 \leq a/A \leq 0.60$ is satisfied, where: "A" is a length of the inner layer within the projective plane along a widthwise direction of the inner layer; and "a" is a length of an overlap area between the inner layer and the noble metal tip within the projective plane along the widthwise direction of the inner layer.

The expression "widthwise direction of the inner layer" refers to a direction orthogonal to a plane including both the axial line and the center axis of the ground electrode.

According to Configuration 14, the overlap area between the inner layer and the noble metal tip along the center axis of the ground electrode can be made larger. Therefore, the performance for conducting heat of a noble metal tip can further be enhanced.

When 0.35>a/A stands, an effect of enhancement of the performance for conducting heat of a noble metal tip may not be sufficiently yielded. In contrast, when a/A>0.60 stands; namely, when the volume of noble metal tip embedded in a ground electrode is further increased, it becomes difficult to join the noble metal tip by means of resistance-welding. For this reason, it becomes necessary to make a recess in the ground electrode by cutting, or the like, and to subsequently join the noble metal tip to the recess. Therefore, when a/A>0.60 stands, an increase in the number of processes employed when a noble metal tip is joined may be aroused. Further, a breakage, or the like, may occur in the ground electrode while the recess is taken as a base point, or the ground electrode may become liable to heating.

Configuration 15: In the spark plug for use in an internal combustion engine of the present configuration, in any one of Configurations 1 to 14, a relationship of $0.07 \leq b/A \leq 0.40$ is satisfied, where: "A" is a length of the inner layer within the projective plane along a widthwise direction of the inner layer; and "b" is a length of an overlap area between the inner layer and the noble metal tip within the projective plane along a direction orthogonal to the widthwise direction of the inner layer.

According to Configuration 15, an overlap area between the inner layer and the noble metal tip along the center axis of the ground electrode can further be increased. Consequently, further enhancement of the performance for conducting heat of a noble metal tip can be sought.

When 0.07>b/A stands, an effect of enhancement of the performance for conducting heat of a noble metal tip may not be sufficiently yielded. In contrast, when b/A>0.40 stands, an increase in the number of processes employed when a noble metal tip is joined or occurrence of a breakage, or the like, which would otherwise occur in the ground electrode while the recess is taken as a base point, may be aroused as in the aforementioned case where a relationship of a/A>0.60 is set.

BEST MODE FOR CARRYING OUT THE INVENTION

An embodiment will be hereinbelow described by reference to the drawings. FIG. 1 is a partially-cutaway front view showing a spark plug for use in an internal combustion engine (hereinafter referred to as a "spark plug") 1. In FIG. 1, a direction of an axis CL1 of the spark plug 1 is assumed to be a vertical direction in the drawing, and descriptions are provided on the assumption that a lower side is a leading end of the spark plug 1 and that an upper side is a base end of the same.

The spark plug 1 includes a cylindrical insulator 2 acting as an insulator, a cylindrical metal shell 3 that holds the insulator, and the like.

The insulator 2 is formed by sintering alumina and the like as is well known, and includes, on an outer shaper thereof, a base-end-side body portion 10 formed at a base-end side, a large-diameter portion 11 formed on a leading-end side of the base-end-side body portion 10 so as to outwardly project in a radial direction, an intermediate body portion 12 formed on the leading-end side of the large-diameter portion 11 so as to have a diameter smaller than that of the large-diameter portion 11, and a leg portion 13 formed on the leading-end side of the intermediate body portion 12 so as to have a diameter smaller than that of the intermediate body portion 12. In the insulator 2, the large-diameter portion 11, the intermediate body portion 12, and the majority of the leg portion 13 are housed in the metal shell 3. A tapered step portion 14 is formed in a connection between the leg portion 13 and the intermediate body portion 12, and the insulator 2 is engagedly fastened to the metal shell 3 by means of the step portion 14.

Further, an axial hole 4 is formed in the insulator 2 in a penetrating fashion along an axis CL1. A center electrode 5 is fixedly inserted to the leading-end side of the axial hole 4. The center electrode 5 as a whole has a rod shape (a columnar shape), and a leading-end face of the center electrode 5 is formed flat and protrudes from the leading end of the insulator 2. Moreover, the center electrode 5 includes an inner layer 5A made of copper or a copper alloy and an outer layer 5B made of a Ni alloy containing nickel (Ni) as a main component. Further, the columnar noble metal portion 31 made of a noble metal alloy (e.g., an Iridium alloy) is provided on the leading end of the center electrode 5. More specifically, the noble metal portion 31 is formed by producing the fused portion 41 [see FIG. 2(*a*), and others] on an outer periphery of a contact face between the outer layer 5A and the noble metal portion 31 by means of laser welding, and the like.

A terminal electrode 6 is fixedly inserted into a base-end side of the axial hole 4 while projecting out of the base end of the insulator 2.

A columnar resistor 7 is provided at a position in the axial hole 4 between the center electrode 5 and the terminal electrode 6. Ends of the resistor 7 are electrically connected to the center electrode 5 by way of a conductive glass seal layer 8 and to the terminal electrode 6 by way of a conductive glass seal layer 9, respectively.

In addition, the metal shell 3 is cylindrically made of metal, such as low carbon steel. A thread (an external thread) 15 used for mounting the spark plug 1 to an engine head is formed on an outer periphery of the metal shell. A seat 16 is formed on an outer periphery on the base-end side of the thread 15, and a ring gasket 18 is fitted around a thread neck 17 provided at the base end of the thread 15. Moreover, a tool engagement portion 19, which is used for engagement of a tool such as a wrench when the metal shell 3 is fastened to the engine head and which has a hexagonal cross-sectional profile, is provided on a base-end side of the metal shell 3. A clamping portion 20 for holding the insulator 2 is provided on the base end of the metal shell.

A tapered step 21 for engagedly fastening the insulator 2 is provided on an internal periphery of the metal shell 3. The insulator 2 is inserted from the base-end side to the leading-end side of the metal shell 3. An opening provided on the base-end side of the metal shell 3 is inwardly clamped in the radial direction while the step 14 of the insulator remains engagedly fastened to the step 21 of the metal shell 3; namely, the clamping portion 20 is formed, whereby the insulator 2 is fastened. An annular plate packing 22 is sandwiched between the step 14 of the insulator 2 and the step 21 of the metal shell 3. Airtightness in a combustion chamber is thereby held, to thus prevent leakage, to the outside, of a fuel air entering a gap between the leg 13 of the insulator 2 exposed to the inside of the combustion chamber and the internal periphery of the metal shell 3.

Further, in order to make more perfect the airtightness achieved by clamping, annular ring members 23 and 24 are interposed between the metal shell 3 and the insulator 2 on the base-end side of the metal shell 3, and space between the ring members 23 and 24 is filled with powder of talc (talc) 25.

Specifically, the metal shell 3 holds the insulator 2 by way of the plate packing 22, the ring members 23 and 24, and the talc 25.

A ground electrode 27 made of a Ni alloy, and the like, is joined to a leading-end face of the leading end portion 26 of the metal shell 3. In addition, the ground electrode 27 is formed such that a distal-end face 27*f* opposes a side surface of the center electrode 5 (a noble metal portion 31) by means of a distal-end side of the ground electrode being bent.

Moreover, in the present embodiment, the ground electrode 27 is built from a two-layer structure consisting of an outer layer 27A and an inner layer 27B, as shown in FIG. 2(*a*). More specifically, the outer layer 27A is made of a Ni alloy [e.g., Inconel 600 or Inconel 601 (both of which are registered trademarks)]. In the meantime, the inner layer 27B is made of a copper alloy or pure copper that is metal superior to the Ni alloy in terms of thermal conductivity. In addition, as shown in FIG. 2(*b*), the ground electrode 27 has a circular cross-sectional profile, and the maximum cross-sectional area of the ground electrode 27 is set to 3.3 $mm^2$ or less within a cross section perpendicular to a center axis CL2 of the ground electrode 27.

Turning back to FIG. 2(*b*), a prismatic noble metal tip 32 made of a noble metal alloy (e.g., a platinum alloy) is joined to a distal end of an inner periphery 27*i* of the ground electrode 27. More specifically, the noble metal tip 32 is joined in such a way that a portion of the noble metal tip 32 is embedded in the ground electrode 27 and that a distal-end face 32*f* of the noble metal tip protrudes from the distal-end face 27*f* of the ground electrode 27 in a direction orthogonal to the axial line CL1. A spark discharge gap 33 acting as clearance is formed between a side surface of the noble metal portion 31 and the distal end of the noble metal tip 32, and spark discharge is emitted in a direction substantially orthogonal to the axial line CL1.

Further, as shown in FIG. 3(*a*), the noble metal tip 32 is joined to the ground electrode 27 such that the distal-end face 32*f* of the noble metal tip 32 opposes the side surface of the center electrode 5 (the noble metal portion 31). More specifically, the noble metal tip 32 is joined to the ground electrode 27 while a center axis CL3 of the noble metal tip 32 is displaced 0.1 mm or more from the center axis CL2 of the ground electrode 27 toward the base end side (toward the metal shell 3) along the axial line CL1. A distal end of the inner layer 27B is situated closer to the axial line CL1 than a straight line SL that is an extension of the inner periphery of the metal shell 3 along the axial line CL1 (namely a base end of the ground electrode 27) within a cross section through which the center axis CL2 of the ground electrode 27 and the axial line CL1 pass. The inner layer 27B is provided while extending up to the distal end of the ground electrode 27. In the present embodiment, the shortest distance C between the inner layer 27B and the noble metal tip 32 is set so as to range from 0.5 mm to 2 mm (e.g., 1 mm). In addition, the length D (a joined portion length) of a portion of the noble metal tip 32 joined to the ground electrode 27 along the center axis CL2 of the ground electrode 27 is set so as to range from 0.5 mm to 1.5 mm. The depth E of an embedded portion of the noble metal tip 32 from the inner periphery 27*i* of the ground electrode 27 is set to 0.1 mm or more.

As shown in FIG. 3(*b*), an overlap area OA (a dotted portion in the drawing) between the inner layer 27B in the projective plane PH and the noble metal tip 32 occupies a ratio (overlap ratio) of 25% or more of the inner layer 27B in the projective plane PH, where the projective plane PH is defined by projecting, along the center axis CL2 of the ground electrode 27, a plane of the ground electrode 27 viewed from its distal-end face 27*f* on a cross section including the maximum cross-sectional area of the inner layer 27B among cross sections orthogonal to the center axis CL2 of the ground electrode 27.

A method for manufacturing the spark plug 1 constructed as mentioned above will now be described. First, the metal shell 3 is processed in advance. Specifically, a through hole is formed in a columnar metal material (an iron-based material and a stainless steel material, for example, S17C and S25C) by means of cold forging, thereby making a rough shape. The material is subsequently machined, to thus trim an outer shape and acquire a semi-manufactured metal shell.

Subsequently, the ground electrode 27 having a double-layer structure consisting of a Ni alloy and a copper alloy is resistance-welded to a leading-end face of the semi-manufactured metal shell. Since a so-called "sag" occurs during welding, the thread 15 is formed in a predetermined portion of the semi-manufactured metal shell through rolling after separation of the "sag." The metal shell 3 to which the ground electrode 27 is welded is thus acquired. The metal shell 3 to which the ground electrode 27 is welded is subjected to zinc or nickel plating. In an attempt to enhance corrosion resistance, the surface of the metal shell can further be plated with chrome.

In the meantime, the insulator 2 is molded in advance separately from the metal shell 3. For example, a granulated base material for a molding is prepared by use of a powdery material that includes alumina as the main component and that also contains a binder, and the like, and rubber press molding is performed by use of the granulated substance, whereby a cylindrical molded element is obtained. The thus-obtained molded element is machined, to thus be trimmed. The thus-trimmed element is charged into a kiln and sintered, whereby the insulator 2 is obtained.

Separately from the metal shell 3 and the insulator 2, the center electrode 5 is previously manufactured. Specifically, a Ni alloy is forged, and the inner layer 5A made of a copper alloys is provided at the center of the Ni alloy in an attempt to enhance a heat radiation characteristic. Next, the noble metal portion 31 is laser-welded to the leading-end face of the center electrode 5. More specifically, after the leading-end face of the outer layer 5B and the base-end face of the columnar noble metal portion 31 are stacked one on top of the other, an outer periphery of a contact area between the faces is exposed to a laser beam, whereby a fused portion 41 is formed. The noble metal portion 31 is thus provided at the leading end of the center electrode 5.

The insulator 2, the center electrode 5, the resistor 7, and the terminal electrode 6, which are thus acquired, are fixedly sealed by glass seal layers 8 and 9. The glass seal layers 8 and 9 are usually prepared by mixing together borosilicate glass and metal powder. The thus-prepared substance is poured into the axial hole 4 of the insulator 2 in such a way that the resistor 7 is sandwiched, and the prepared substance is subsequently pressed by the terminal electrode 6 from behind while the insulator 2 is heated in the kiln, whereby the glass seal layer is fired and hardened. At this time, glazing layer can also be simultaneously sintered over the surface of the body 10 on the base-end side of the insulator 2, or the glazing layer can also be formed in advance.

Subsequently, the insulator 2 having the center electrode 5 and the terminal electrode 6, which are manufactured as mentioned above, and the metal shell 3 having the ground electrode 27 are assembled together. More specifically, the opening that is comparatively, thinly formed on the base-end side of the metal shell 3 is clamped inwardly with respect to the radial direction; namely, the clamping portion 20 is formed, whereby the insulator 2 and the metal shell 3 are fastened together.

Next, the noble metal tip 32 is resistance-welded to the distal end of the ground electrode 27. At this time, the noble metal tip 32 is comparatively, deeply embedded in the ground electrode 27. Thereby, the overlap area OH between the inner layer 27B in the projective plane PH and the noble metal tip 32 occupies the ratio (overlap ratio) of 25% or more of the inner layer 27B in the projective plane PH. Finally, the ground electrode 27 is bent, whereby machining for adjusting the spark discharge gap 33 between the center electrode 5 (the noble metal portion 31) and the noble metal tip 32 provided on the ground electrode 27 is carried out.

As aforementioned in detail, according to the present embodiment, the ground electrode 27 has a double-layer structure including the outer layer 27A and the inner layer 27B containing a material that is superior to the outer layer 27A in terms of thermal conductivity. Within a cross section through which the center axis CL2 of the ground electrode 27 and the axial line CL1 pass, the inner layer 27B extends up to a position where the cross section reaches the straight line SL that is the extension of the inner periphery of the metal shell 3 to the leading end side along the axial line CL1 (in the present embodiment, the inner layer 27B extends up to a position at which the shortest distance between the inner layer 27B and the noble metal tip 32 comes to 0.5 mm to 2 mm). Specifically, the inner layer 27B exhibiting superior thermal conductivity is provided up to a position that is comparatively close to the noble metal tip 32. Therefore, it is possible to easily conduct heat of the noble metal tip 32 by way of the inner layer 27B, which in turn enhances the performance for conducting heat of the noble metal tip 32.

Further, the noble metal tip 32, which is to be located at the center of the combustion chamber and subjected to a larger quantity of heat, is joined to the ground electrode 27 while a center axis CL3 of the noble metal tip is displaced (displaced 0.1 mm or more in the present embodiment) toward the base-end side in the axial line CL1 (toward the metal shell 3) than the center axis CL2 of the ground electrode 27. Namely, the noble metal tip 32 is disposed at a position spaced from the center of the combustion chamber. Therefore, the quantity of heat to which the noble metal tip 32 is subjected during combustion can be comparatively reduced, so that a drop in separation resistance and durability can be more reliably prevented.

Further, the overlap area OH between the inner layer 27B and the noble metal tip 32 within the projective plane PH is set to 25% or more of the area of the inner layer 27B within the projective plane PH. As a result, a large quantity of heat of the noble metal tip 32 can be conducted toward the metal shell 3 by way of the inner layer 27B exhibiting superior thermal conductivity, so that the performance for conducting heat of the noble metal tip 32 can be more enhanced. As a consequence, the greater betterment of separation resistance and durability can be sought.

Moreover, the length of the portion of the noble metal tip 32 joined to the ground electrode 27 (the length of the joined portion) achieved along the center axis CL2 of the ground electrode 27 is set so as to range from 0.5 mm to 1.5 mm. Hence, the potential of occurrence of welding irregularities in respective joined portions can be minimized, and sufficient bonding strength can be assured. Consequently, greater enhancement of separation resistance can be sought.

In addition, the noble metal tip 32 is joined to the ground electrode 27 to a sufficient depth E (0.1 mm or more). Hence, joining strength between the noble metal tip 32 and the ground electrode 27 can be enhanced and, by extension, greater betterment of separation resistance can be sought.

As mentioned above, advantageous effects exhibited by the respective areas act in a combined fashion, and the separation resistance and durability of the noble metal tip 32 can be improved by leaps and bounds by means of interaction of the advantageous effects.

In the present embodiment, the ground electrode 27 is formed to have a circular cross-sectional profile. Hence, inflow of a mixed air into the spark discharge gap 33 can be facilitated, so that betterment of ignitability can be sought.

The distal-end face 32*f* of the noble metal tip 32 protrudes from the distal-end face 27*f* of the ground electrode 27 in the direction orthogonal to the axial line CL1; hence, greater enhancement of ignitability can be sought.

In order to ascertain effects yielded by the present embodiment, a relationship between the ratio at which an overlap between the inner layer and the noble metal tip occupies the projective plane and the temperature of the noble metal tip was analyzed through a simulation compliant with a finite element method (FEM). Detailed descriptions about simulation analysis are now provided. When the spark plug was mounted on the engine (i.e., heat was conducted from the ground electrode toward the metal shell) and when the overlap ratio was 0%, an ambient temperature was set in such a way that the temperature of the noble metal tip came to 1000° C. Changes in the temperature of the noble metal tip along with a change in the overlap ratio were analyzed. FIG. 4 shows an analysis result.

As shown in FIG. 4, when the overlap ratio is under 25%, substantial changes in the temperature of the noble metal tip are hardly seen. However, when the overlap ratio comes to 25% or more, a decrease in the temperature of the noble metal tip and efficient heat conduction of the noble metal tip are evidently shown. A conceivable reason for them is that heat of the noble metal tip is efficiently conduction toward the metal shell by way of the inner layer exhibiting superior thermal conductivity.

It is also seen that, when the overlap ratio comes to 28% or more, a greater decrease in the temperature of the noble metal tip and more efficient heat conduction of the noble metal tip are achieved. Therefore, from the viewpoint of fulfillment of much superior performance for conducting heat of a noble metal tip, setting the overlap ratio to 28% or more (e.g., 30% or more) can be said to be more preferable.

Next, sample spark plugs variously changed in terms of the amount of displacement of the center axis of the noble metal tip with respect to the center axis of the ground electrode (the amounts of tip displacement) were fabricated, and the respective samples were subjected to a heat-cold endurance test. An overview of the heat-cold endurance test is as follows. Specifically, the respective samples are mounted to four-valve, 2000-cc engine. One cycle includes an idled state for one minute and a loaded state (the number of rotations of the engine=5000 rpm) for one minute. The engines were driven over 100 cycles. After completion of the 100 cycles, cross sections of the respective samples were observed, whereby a ratio (an oxidized scale ratio) of a length K of a resultant oxidized scale (see FIG. 6) to a length J (see also FIG. 6 that is a schematic view) of a boundary area between the ground electrode and the noble metal tip was measured. A graph in FIG. 5 shows a relationship between the amount of tip displacement and the oxidized scale ratio. The greater oxidized scale ratio signifies occurrence of greater thermal stress difference in the joined portion between the ground electrode and the noble metal tip, which in turn means insufficient separation resistance. Moreover, the amount of tip displacement is expressed on the assumption that the amount of displacement toward the leading-end side in the axial direction with respect to the center axis of the ground electrode taken as a point of reference is represented by a negative sign and that the amount of displacement toward the base-end side in the axial direction with reference to the center axis of the ground electrode taken as the point of reference is expressed by a positive sign.

As shown in FIG. 5, it is understood that the samples having tip displacements of 0 mm or more can reduce the oxidized scale ratio to comparatively low levels and exhibit sufficient separation resistance. A conceivable reason for them is that, since the noble metal tip was provided at a location spaced from the center of the combustion chamber, quantities of heat to which the noble metal tips were subjected during combustion could be comparatively reduced. Further, it is evident that the samples having tip displacements of 0.1 mm or more show oxidized scale ratios of less than 40% and exhibit superior separation resistance. Therefore, from the viewpoint of accomplishment of much greater improvements in separation resistance, it can be said to be more desirable that the amount of tip displacement is set to a value of 0.1 mm or more.

Sample spark plugs variously changed in terms of the shortest distance "SC" between the inner layer and the noble metal tip were produced. The respective samples were subjected to a desk burner evaluation test [a sample is heated for two minutes by means of a burner in such a way that a noble metal tip comes to 950° C., and the thus-heated sample is slowly cooled for one minute. These operations make up one cycle, and the test is conducted by repeating the operations 1000 cycles]. Subsequently, an oxidized scale ratio was measured. FIG. 7 shows a graph representing a relationship between the shortest distance "SC" and the oxidized scale ratio.

As shown in FIG. 7, it is understood that, when the shortest distance "SC" between the noble metal tip and the inner layer is set to a value under 0.5 mm and when the shortest distance "SC" exceeds 2 mm, the oxidized scale ratio exceeds 50%, whereby separation resistance becomes insufficient. A conceivable reason for this is as follows. Specifically, when the shortest distance "SC" is set to a value under 0.5 mm, the heat of the noble metal tip is excessively conducted, which induces comparatively-large thermal stress in a joined portion between the ground electrode and the noble metal tip. Another conceivable reason is that, when the shortest distance "SC" exceeds 2 mm, heat became less likely to conduct from the noble metal tip to the inner layer, which in turn caused insufficient heat conduction of the noble metal tip.

In the meantime, it has become clear that, when the shortest distance "SC" between the noble metal tip and the inner layer is set so as to range from 0.5 mm to 2 mm, the oxidized scale ratio comes to less than 50%, and superior separation resistance is exhibited. A conceivable reason for this is that heat of the noble metal tip can be sufficiently conducted to such an extent that heat conduction does not become excessive. From the viewpoint of further enhancement of separation resistance, setting the shortest distance "SC" so as to range from 0.5 mm to 1.8 mm; more preferably, the shortest distance "SC" so as to range from 1 mm to 1.5 mm, can be said to be more preferable.

Sample spark plugs variously modified in terms of the length "SD" of the joined portion of the noble metal tip to the ground electrode and the depth of an embedded portion (SE) were produced. The respective samples were subjected to a desk burner evaluation test [a sample is heated for two minutes by means of a burner in such a way that a noble metal tip comes to 1000° C., and the thus-heated sample is slowly cooled for one minute. These operations make up one cycle, and the test involves repetition of the cycles]. Subsequently, the number of cycles during which an oxidized scale ratio came to 50% (a 50%-oxidized-scale attainment cycle) was measured. FIG. 8 shows test results. In the drawing, test results acquired when the depth of an embedded portion "SE" was set to 0.05 mm are plotted with a cross sign. Test results acquired when the depth of the embedded portion "SE" was set to 0.1 mm are plotted with a solid square sign. Test results acquired when the depth of the embedded portion "SE" was set to 0.2 mm are plotted with a solid round sign. Test results acquired when the depth of the embedded portion "SE" was set to 0.3 mm are plotted with a solid triangular sign.

As shown in FIG. 8, the 50%-oxidized-scale attainment cycle comes to less than 1000 cycles in connection with the samples whose joined portions have lengths "SD" of less than 0.5 mm, which shows that an oxidized scale is likely to develop; namely, that separation resistance is insufficient. A conceivable reason for this is that sufficient bonding strength could not be assured because the joined portion was too small. The 50%-oxidized-scale attainment cycle comes to less than 1000 cycles even in connection with the samples whose joined portions have lengths "SD" of 1.5 mm or more, which shows that separation resistance is insufficient. A conceivable reason for this is that welding irregularities occurred in respective joined portions because the portions of the noble metal tips joined to their corresponding ground electrodes were too large.

In contrast, the 50%-oxidized-scale attainment cycle exceeds 1000 cycles even in connection with the samples whose joined portions have lengths "SD" ranging from 0.5 mm to 1.5 mm, with exception of the samples whose joined portions have a depth "SE" of 0.05 mm, which shows that superior separation resistance is exhibited. A conceivable reason for this is that the possibility of occurrence of welding irregularities could be minimized and that sufficient bonding strength could be assured.

A relationship between the maximum cross-sectional area of the ground electrode and the temperature of the noble metal tip was analyzed through a simulation compliant with the finite element method (FEM) [conditions for the simulation, such as a temperature, were set as follows; namely, the ambient temperature was set in such a way that the temperature of the noble metal tip came to 1000° C. while the spark plug was mounted on the engine (i.e., in a state where heat was conducted from the ground electrode to the metal shell) and while the overlap ratio was 0%]. There is computed a relationship of a ratio (a temperature drop rate) showing an extent to which the temperature of the noble metal tip decreases when the overlap ratio is set to 50% while taking, as a reference, the maximum cross-sectional area of the ground electrode and the temperature of the noble metal tip achieved when the overlap ratio is set to 0%. FIG. 9 shows the relationship between the maximum cross-sectional area of the ground electrode and the temperature drop rate.

As shown in FIG. 9, it is clear that a temperature drop rate becomes comparatively larger in connection with samples whose ground electrodes have maximum cross-sectional areas of 3.3 $mm^2$ or less. Specifically, in relation to a ground electrode having a comparatively-small cross-sectional area, there is a concern about a decrease in separation resistance and durability. However, it is understood that, when the cross-sectional area of the ground electrode is less than 3.3 $mm^2$, effects yielded by setting the overlap ratio to 25% or more are more effectively yielded. Accordingly, it can be said that setting the overlap ratio to 25% or more is more effective when the cross-sectional area of the ground electrode is comparatively small; namely, 3.3 $mm^2$ or less.

The present invention is not limited to the descriptions about the embodiment but can also be implemented as follows, for example. As a matter of course, it is natural that another example application or modification of the present invention, which is not provided below, will be possible.

(a) For the sake of explanation, the ground electrode 27 is described as having a mere double-layer structure in the embodiment; however, the ground electrode can have a three-layer structure or a multilayer structure of four or more layers. It is desirable that an inner layer with respect to an outer layer 27A includes metal that exhibits higher thermal conductivity than that of the outer layer 27A. For example, an intermediate layer made of a copper alloy or pure copper can also be provided on the inner side of the outer layer 27A, and an innermost layer made of pure nickel can also be provided inside of the intermediate layer. Further, when the ground electrode has a three-layer structure or more, a plurality of layers that are situated inside of the outer layer 27A and that include metal exhibiting thermal conductivity greater than that of the outer layer 27A correspond to the inner layer 27B. When the aforementioned structure having the intermediate layer and the innermost layer, for example, is adopted, the intermediate layer and the innermost layer correspond to the inner layer 27B.

(b) In the embodiment, the noble metal tip 32 is joined while the center axis CL3 of the noble metal tip 32 is displaced 0.1 mm or more from the center axis CL2 of the ground electrode 27 toward the base-end side along the direction of the axial line CL1. The essential requirement is that the center axis CL3 of the noble metal tip 32 is displaced from the center axis CL2 of the ground electrode 27 toward the base-end side along the direction of the axial line CL1. The amount of displacement of the noble metal tip 32 can also be 0.1 mm or less.

(c) As shown in FIGS. 10(*a*) and (*b*), though not particularly described in connection with the embodiment, a distal-end portion of the inner periphery 27*i* of the ground electrode 27 can also be formed flat by means of cutting or pressing and joined to the noble metal tip 32. In this case, the noble metal tip 32 can be joined to the ground electrode 27 in a comparatively-easy, stable manner. As a consequence, the bonding strength of the noble metal tip 32 to the ground electrode 27 can further be enhanced, and greater betterment of separation resistance can be sought. The inner periphery of the ground electrode 27 can be formed so as to have a shape recessed toward the outer-periphery side by cutting, or the like. The noble metal tip 32 is joined to the recess, whereby an overlap area between the inner layer 27B and the noble metal tip 32 achieved along the center axis CL2 of the ground electrode 27 can be increased in a comparatively-easy manner. Consequently, separation resistance and durability can be enhanced in a comparatively-easy and more-reliable manner.

(d) In the embodiment, the distal-end face 32*f* of the noble metal tip 32 is configured so as to oppose the side surface of the center electrode 5 (the noble metal portion 31). However, as shown in FIG. 11, the distal-end face 32*f* of the noble metal tip 32 can also be configured so as to oppose the axial line CL1 situated on the leading-end side with respect to to the center electrode 5. In this case, balanced enhancement of separation resistance and flame propagation can be attained.

(e) As shown in FIG. 12, the end face of the noble metal tip 32 achieved in the direction of the axial line CL1 can also be configured so as to oppose the leading-end portion of the center electrode 5 (the noble metal portion 31). In this case, since the spark discharge gap 33 comes to a position much closer to the center of the combustion chamber, superior ignitability can be accomplished.

(f) In the embodiment, the ground electrode 27 is imparted with a circular cross-sectional profile; however, the cross-sectional profile of the ground electrode 27 is not particularly limited. Accordingly, as shown in FIG. 13(*a*), the ground electrode 27 can also be configured so as to have an oblong cross-sectional profile. Alternatively, as shown in FIG. 13(*b*), the ground electrode can also be configured so as to have a cross-sectional profile (an octagonal cross-sectional profile) that is realized by providing four corners of a rectangular cross-sectional profile with flat-surface-shaped chamfered portions 27*ch*. Alternatively, as shown in FIG. 13(*c*), the ground electrode can also be configured in such a way that the four corners are provided with curved portions 27*cu* in place of the notches 27*ch* (only some of the notches 27*ch* can also be replaced with the curved portions 27*cu*). In this case, as in a case where the ground electrode 27 is provided with a circular cross-sectional profile, inflow of a mixed air into the spark discharge gap 33 can be facilitated, and betterment of ignitability can be sought.

As shown in FIGS. 14(*a*), (*b*), and (*c*), the distal-end portion of the inner periphery 27*i* of the ground electrode 27 can be subjected to cutting, pressing, and the like, thereby making the inner periphery 27*i* flat.

(g) Though not particularly described in the embodiment, arrangement location of the noble metal tip 32 with respect to the inner layer 27B can also be adjusted so as to satisfy a relationship of $0.35 \leq a/A \leq 0.60$ on condition that the length of the inner layer 27B achieved within the projective plane PH along the widthwise direction of the inner layer 27B is taken as "A" and that the length of an overlap area OA achieved within the projective plane PH along the widthwise direction is taken as "a," as shown in FIG. 15. In this case, the overlap area OA between the inner layer 27B and the noble metal tip 32 achieved along the center axis CL2 of the ground electrode 27 can be made greater. Therefore, the performance for conducting heat of the noble metal tip 32 can be enhanced to a much greater extent.

The arrangement location of the noble metal tip 32 with respect to the inner layer 27B can also be adjusted so as to satisfy a relationship of $0.07 \leq b/A \leq 0.40$ on condition that the length of the overlap area OA within the projective plane PH achieved along a direction orthogonal to the widthwise direction of the inner layer 27B is taken as "b." When the noble metal tip is configured so as to satisfy a relationship of $0.07 \leq b/A \leq 0.40$, the overlap area OA can be made much greater. Therefore, further betterment of the performance for conducting heat of the noble metal tip 32 can be accomplished. The performance for conducting heat of the noble metal tip 32 can be enhanced by leaps and bounds by configuring the noble metal tip so as to simultaneously satisfy the relationship of $0.35 \leq a/A \leq 0.60$ and the relationship of $0.07 \leq b/A \leq 0.40$.

(h) In the embodiment, a case where the noble metal portion 31 is provided at the leading-end portion of the center electrode 5 is embodied. However, there can also be adopted a configuration from which the noble metal portion 31 is omitted.

(i) In the embodiment, a case where the ground electrode 27 is joined to the distal-end face of the leading end portion 26 of the metal shell 3 is embodied. However, the present invention is also applicable to a case where a portion of the metal shell (or a portion of leading-end metal fitting which is previously welded to the metal shell) is chipped, to thus create the ground electrode (as described, for example, in JP-A-2006-236906, and the like). Further, the ground electrode 27 can also be joined to a side surface of the leading end portion 26 of the metal shell 3.

(j) In the embodiment, the tool engagement portion 19 is provided with a hexagonal cross-sectional profile; however, the shape of the tool engagement portion 19 is not limited to such a shape. For example, the tool engagement portion can also be imparted with the shape, for example, of Bi-HEX (a modified dodecagon) [ISO22977:2005(E)], and the like.

DESCRIPTION OF REFERENCE SIGNS

Figure 1:
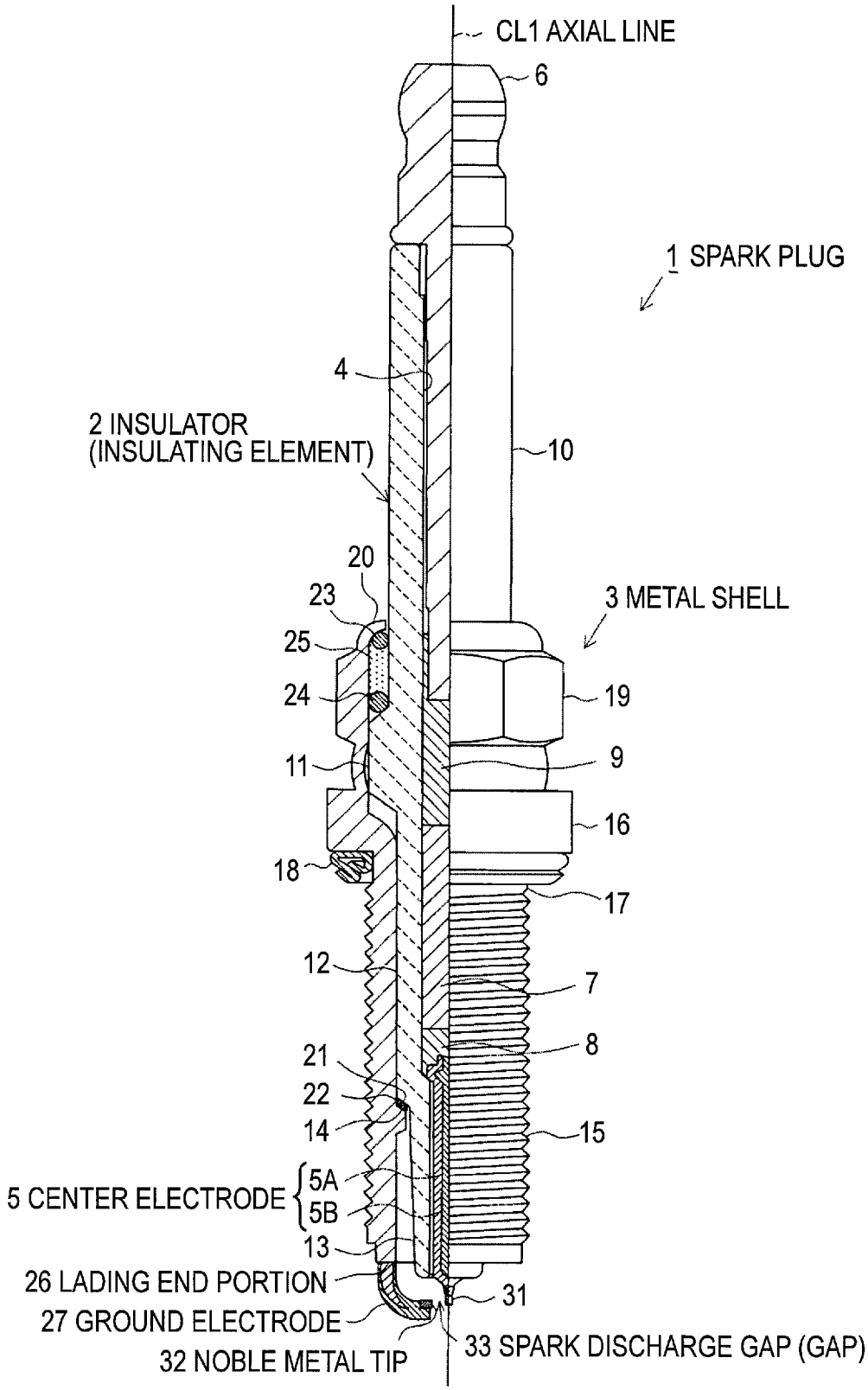
FIG. 1 is a partially-cutaway front view showing the structure of a spark plug of the present embodiment.
Figure 2A:
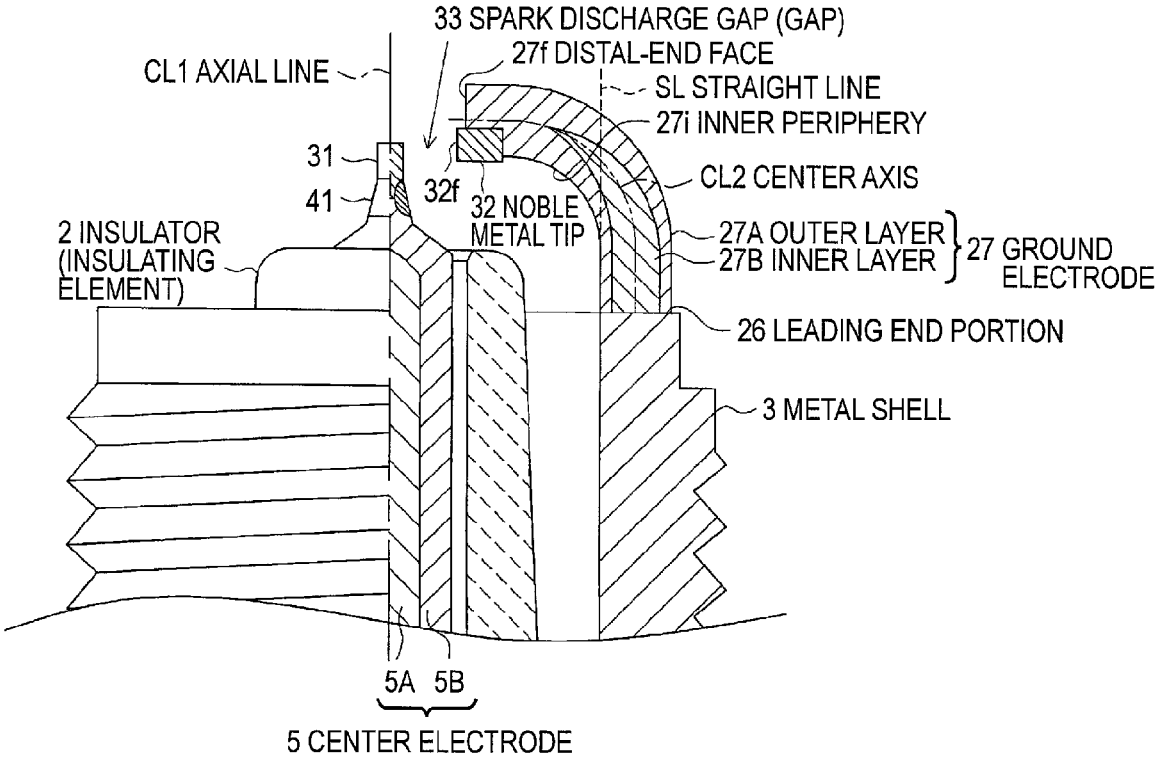
FIG. 2(*a*) is a partially-cutaway, enlarged front view showing the structure of a leading-end portion of the spark plug, and FIG. 2(*b*) is a partially-enlarged side view acquired when a ground electrode, and the like, is viewed from a distal-end side of the ground electrode.
Figure 2B:
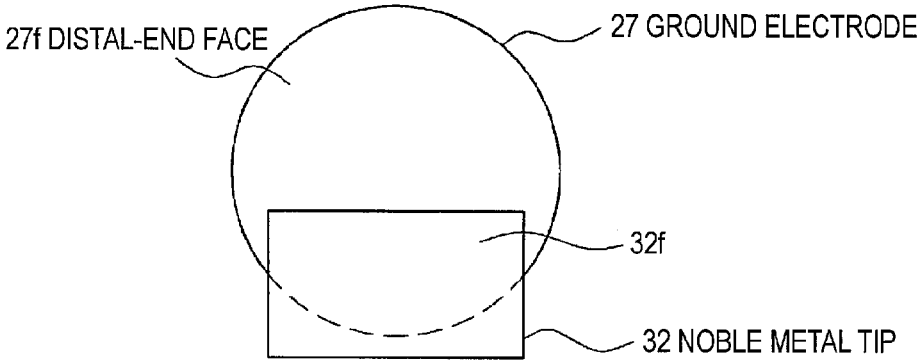
Figure 3A:
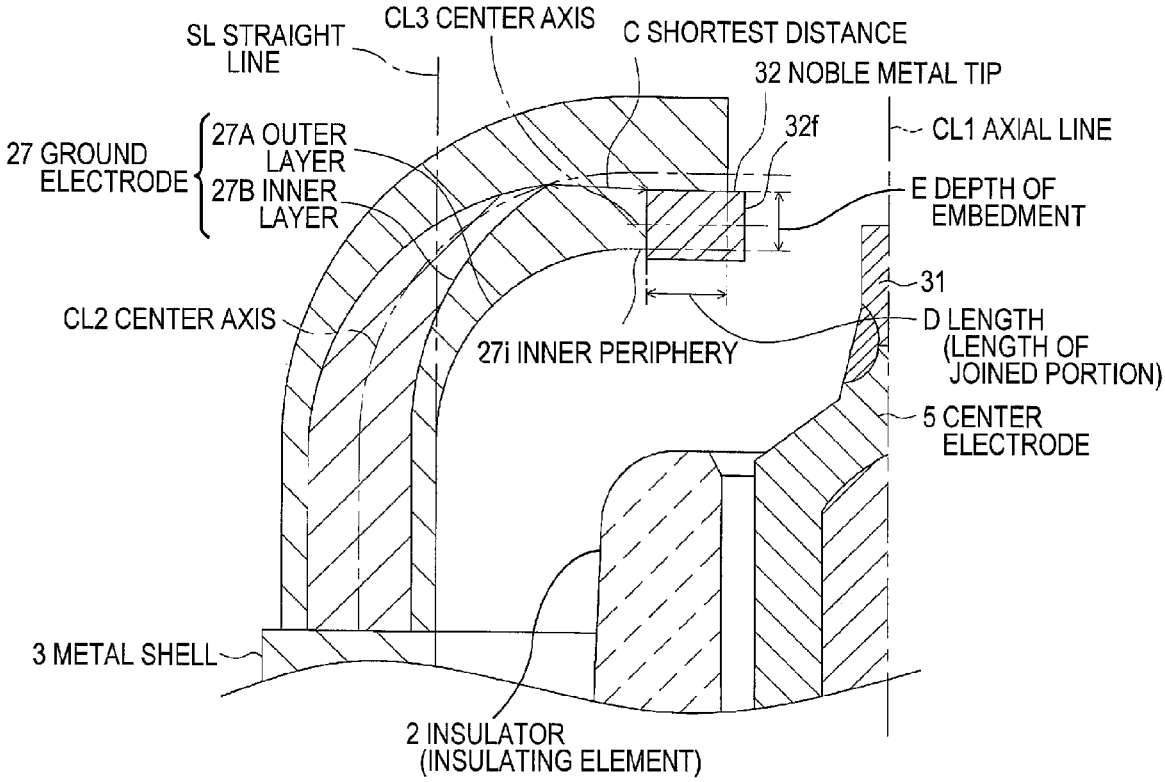
FIG. 3(*a*) is an enlarged cross-sectional view showing the shortest distance, and the like, between an inner layer and a noble metal tip, and FIG. 3(*b*) is a schematic diagram showing an overlap area, and the like, between the inner layer and the noble metal tip within a projective plane.
Figure 3B:
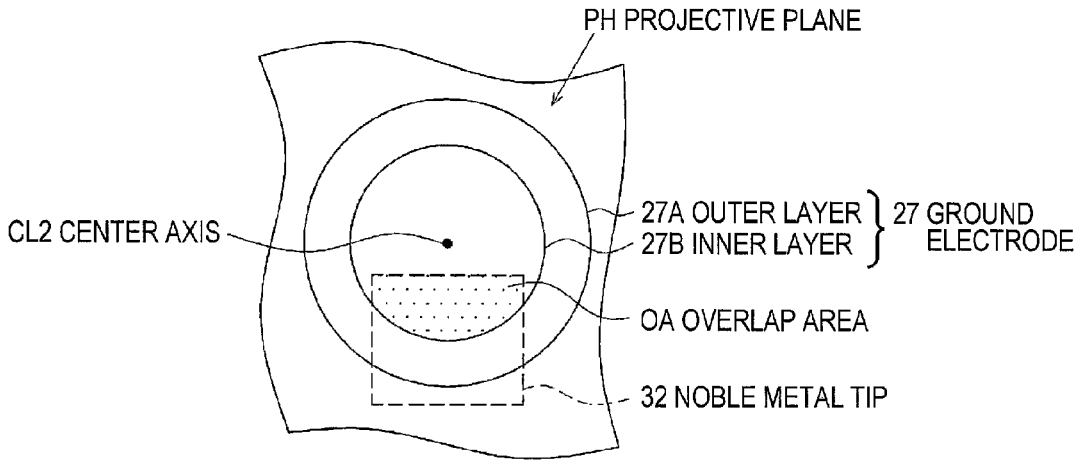
Figure 4:
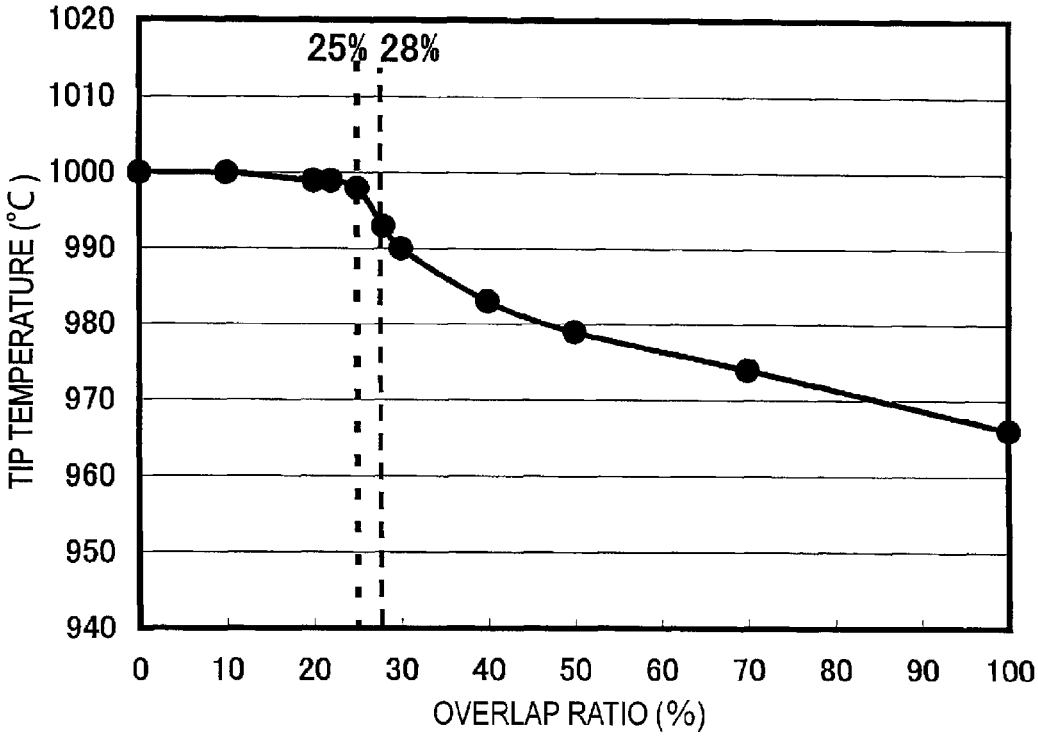
FIG. 4 is a graph showing a relationship between the noble metal tip and an overlap ratio.
Figure 5:
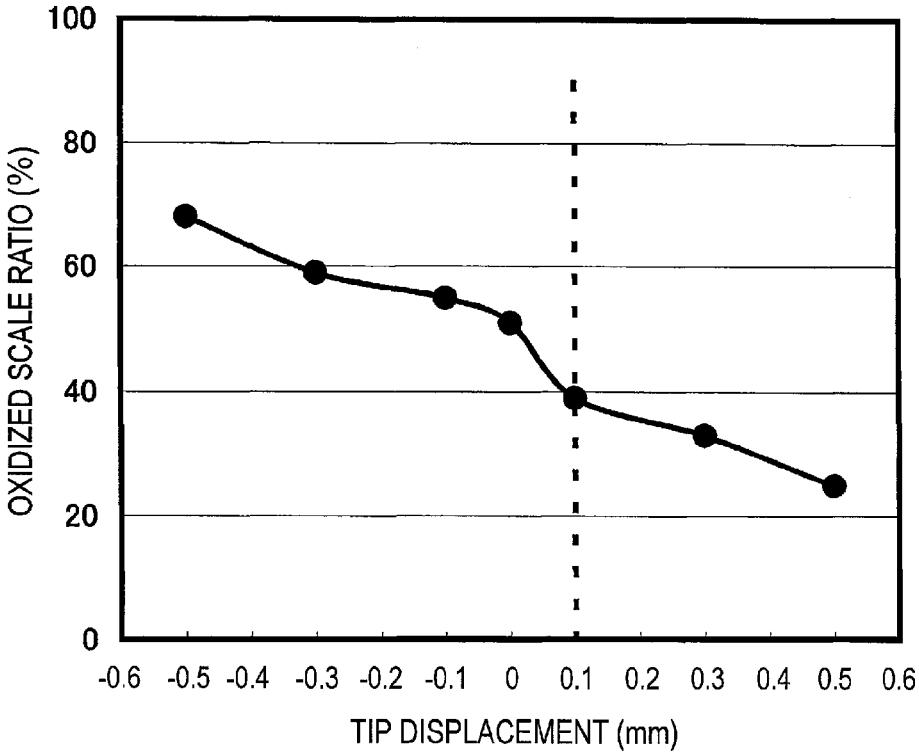
FIG. 5 is a graph showing a relationship between an amount of tip displacement and an oxidized scale ratio.
Figure 6:
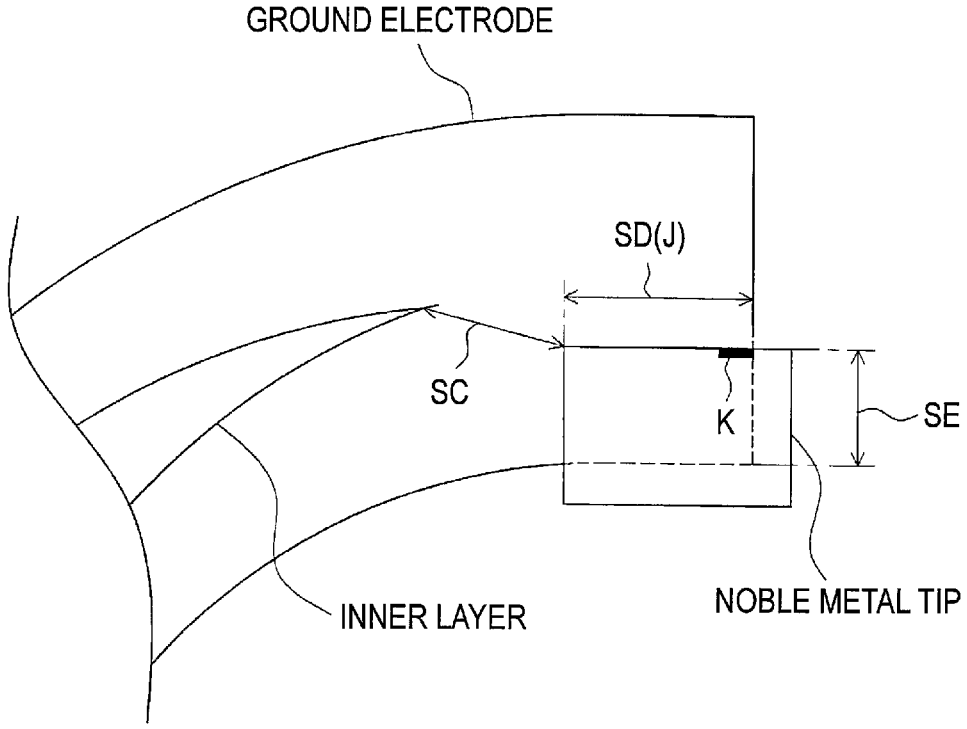
FIG. 6 is a cross-sectional end view for describing the concept of samples used in a test (a hatch pattern is omitted for the sake of convenience)
Figure 7:
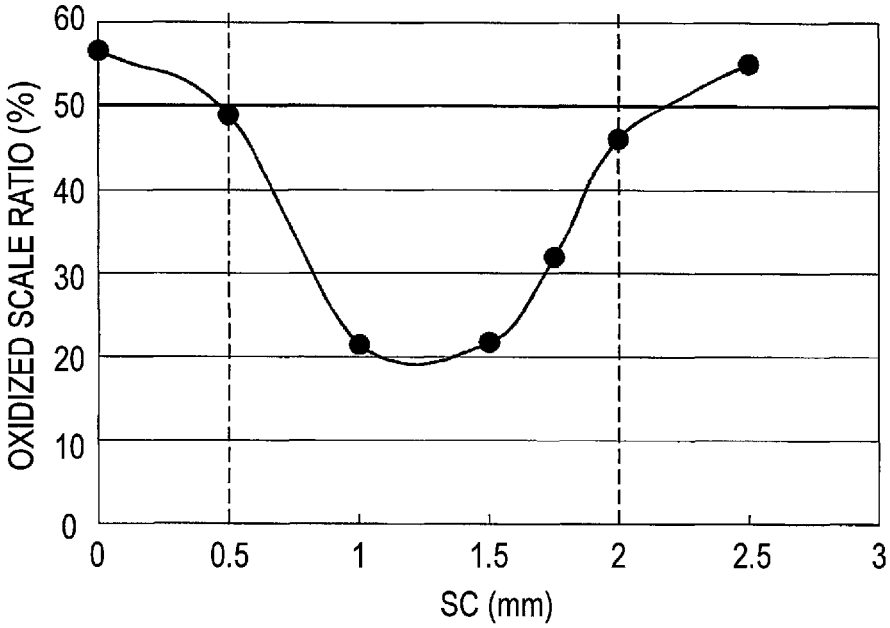
FIG. 7 is a graph showing a relationship between the shortest distance between an inner layer and a noble metal tip and the oxidized scale ratio.
Figure 8:
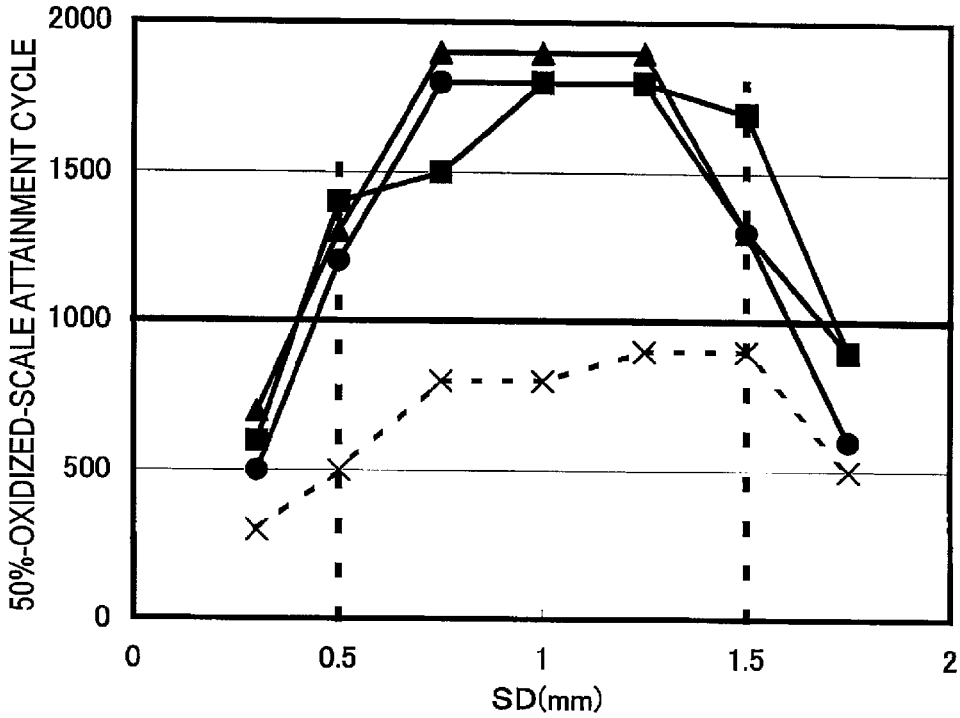
FIG. 8 is a graph showing a relationship between the length of a joined portion, the depth of an embedded area, and an oxidized scale ratio.
Figure 9:
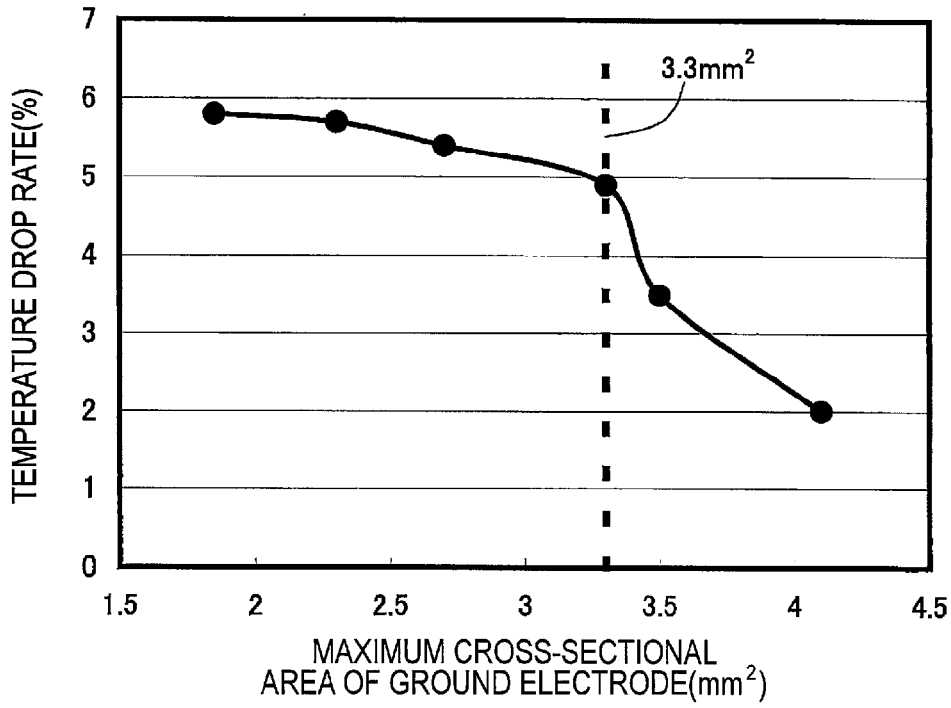
FIG. 9 is a graph showing a relationship between the maximum cross-sectional area of the ground electrode and a temperature drop rate.
Figure 10A:
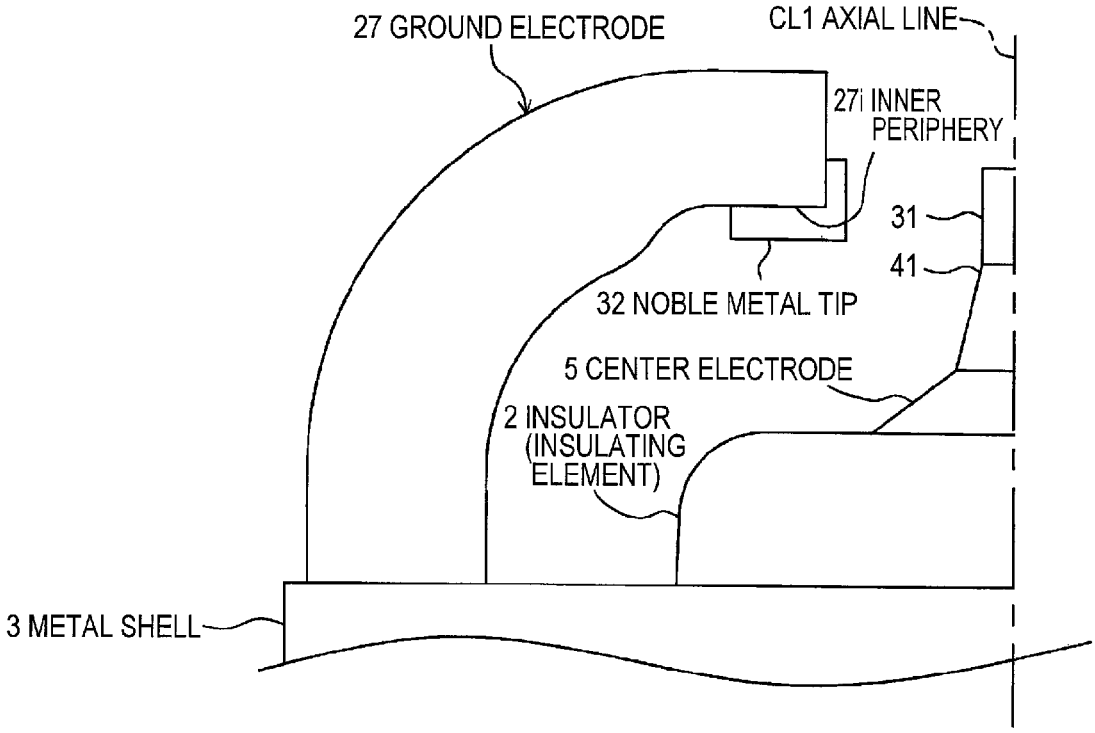
FIG. 10(*a*) is a partially-enlarged front view showing the structure of a ground electrode, and the like, of another embodiment, and FIG. 10(*b*) it is a partially-enlarged side view acquired when the ground electrode, and the like, of the other embodiment is viewed from a distal-end side of the ground electrode.
Figure 10B:
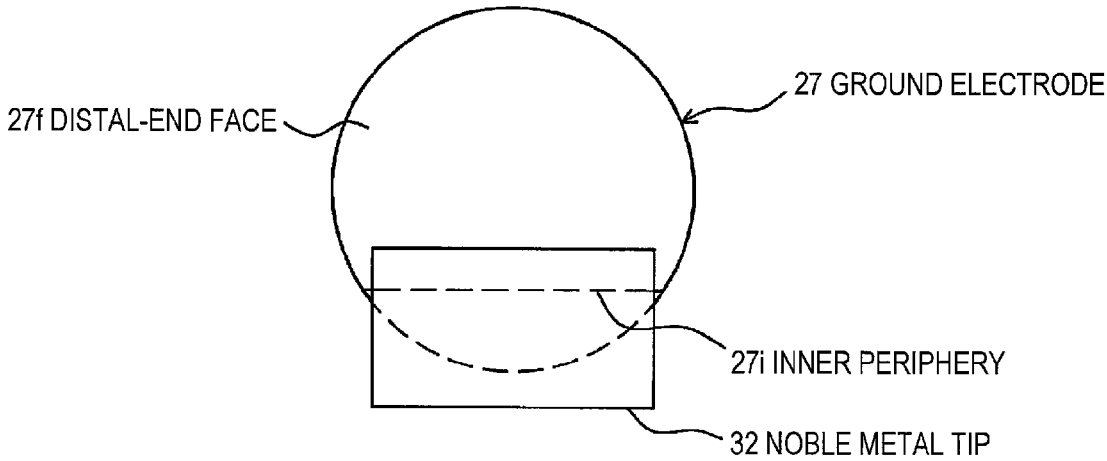
Figure 11:
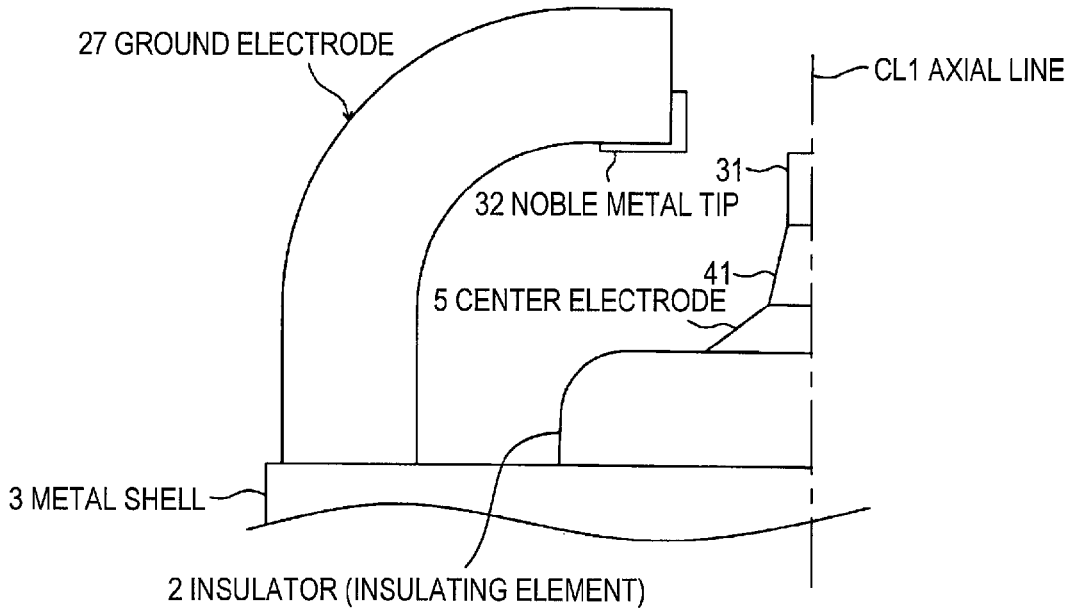
FIG. 11 is a partially-enlarged front view showing the structure of a leading-end portion of a spark plug of another embodiment.
Figure 12:
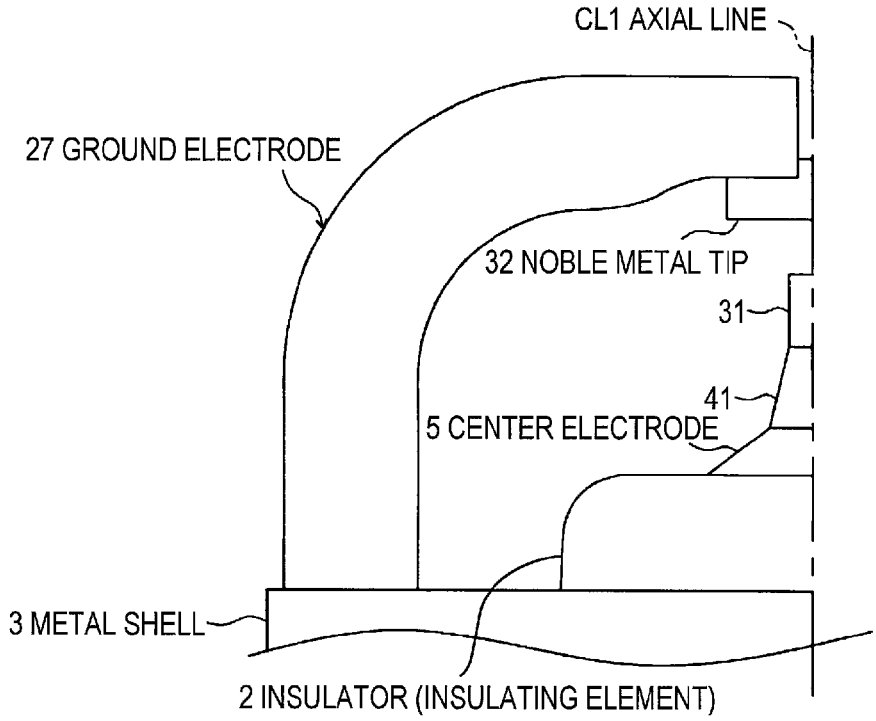
FIG. 12 is a partially-enlarged front view showing the structure of a leading-end portion of a spark plug of another embodiment.
Figure 13A:
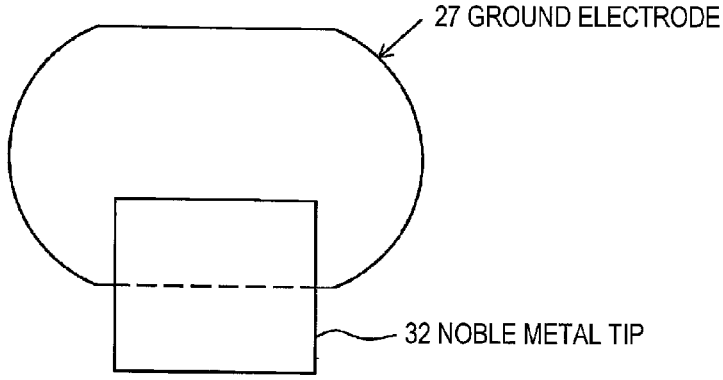
FIG. 13(*a*) to FIG. 13(*c*) are partially-enlarged side views achieved when the ground electrode, and the like, of the other embodiment is viewed from a distal-end face of the ground electrode.
Figure 13B:
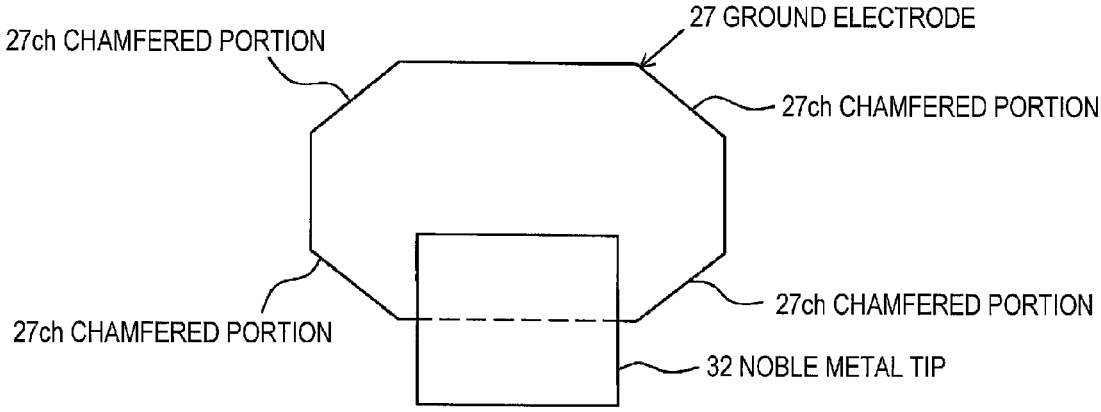
Figure 13C:
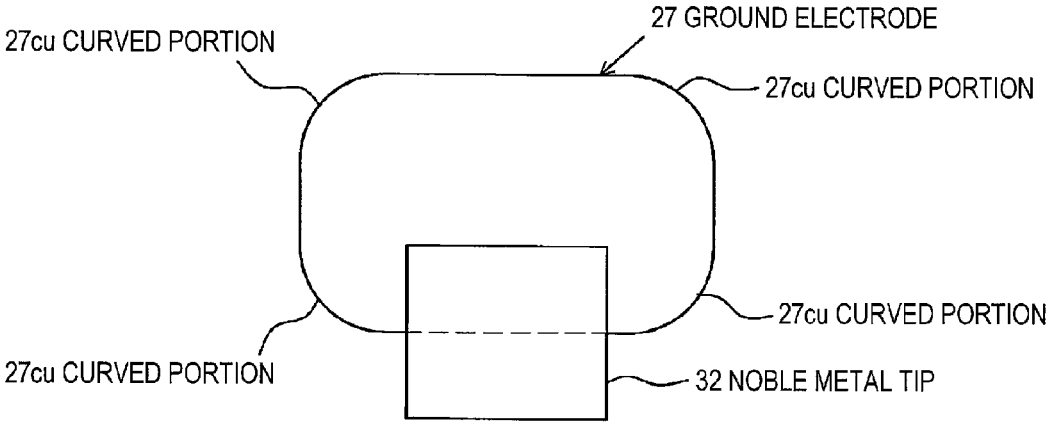
Figure 14A:
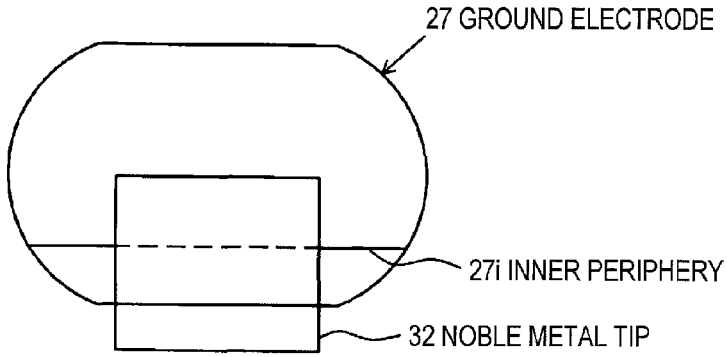
FIG. 14 (*a*) to FIG. 14(*c*) are partially-enlarged side views achieved when the ground electrode, and the like, of the other embodiment is viewed from a distal-end face of the ground electrode.
Figure 14B:
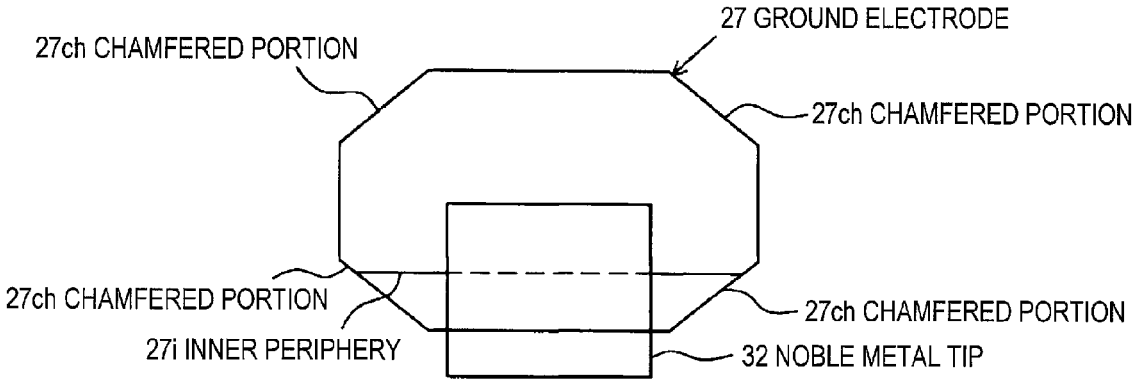
Figure 14C:
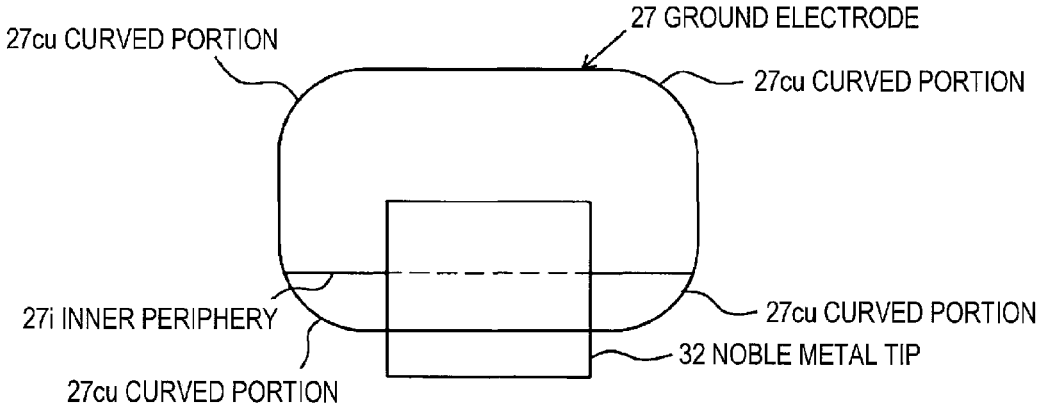
Figure 15:
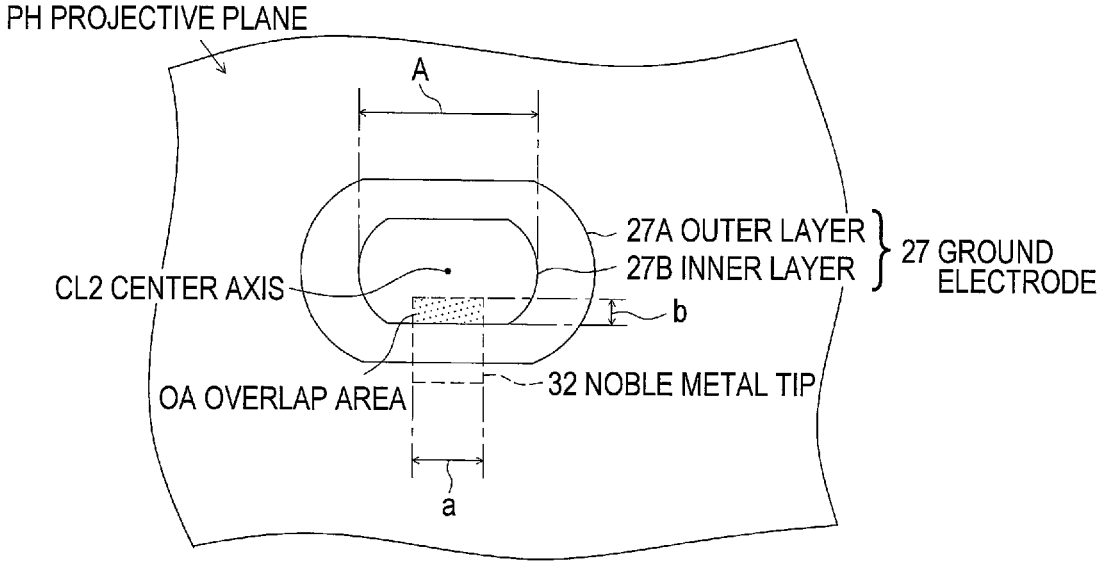
FIG. 15 is a schematic view for showing widthwise lengths, and the like, of an inner layer and an overlap area within a projective plane of the, other embodiment.

1 . . . SPARK PLUG FOR INTERNAL COMBUSTION ENGINE
2 . . . INSULATOR (INSULATING ELEMENT)
3 . . . METAL SHELL
4 . . . AXIAL HOLE
5 . . . CENTER ELECTRODE
26 . . . LEADING END PORTION (OF METAL SHELL)
27 . . . GROUND ELECTRODE
27A . . . OUTER LAYER
27B . . . INNER LAYER
27*f* . . . DISTAL-END FACE (OF GROUND ELECTRODE)
27*i* . . . INNER PERIPHERY (OF GROUND ELECTRODE)
32 . . . NOBLE METAL TIP
32*f* . . . DISTAL-END FACE (OF NOBLE METAL TIP)
33 . . . SPARK DISCHARGE GAP (GAP)
CL1 . . . AXIAL LINE
CL2 . . . CENTER AXIS (OF GROUND ELECTRODE)
CL3 . . . CENTER AXIS (OF NOBLE METAL TIP)
OA . . . OVERLAP AREA
PH . . . PROJECTIVE PROJECTION
SL . . . STRAIGHT LINE
C . . . SHORTEST DISTANCE
D . . . LENGTH (OF JOINED PORTION)
E . . . DEPTH OF EMBEDDED PORTION

The invention claimed is:

1. A spark plug for an internal combustion engine comprising:

a rod-shaped center electrode extending in an axial direction;

a substantially-cylindrical insulator that has an axial hole extending in the axial direction and in which the center electrode is provided in the axial hole;

a substantially-cylindrical metal shell provided around an outer periphery of the insulator;

a ground electrode that extends from a leading end portion of the metal shell and whose distal end is bent toward the center electrode; and a noble metal tip joined to a distal end portion of the ground electrode, wherein:

a gap is formed between the leading end portion of the center electrode and the noble metal tip;

the noble metal tip is joined such that a center axis of the noble metal tip is displaced from a center axis of the ground electrode toward a base-end side in the axial direction;

the ground electrode comprises an outer layer made of a nickel alloy and an inner layer made of a material that exhibits thermal conductivity superior to that of the outer layer;

a distal end of the inner layer is situated closer to the axial line than a base end of the ground electrode; and an overlap area between the inner layer and the noble metal tip occupies a ratio of 25% or more of the inner layer in a projective plane, the projective plane being defined by projecting, along the center axis of the ground electrode, a plane of the ground electrode viewed from a distal-end face side of the ground electrode on a cross section of the ground electrode in which a maximum cross-sectional area of the inner layer is achieved among cross sections orthogonal to the center axis of the ground electrode.

2. The spark plug for use in an internal combustion engine according to claim 1, wherein the overlap area between the inner layer and the noble metal tip occupies a ratio of 28% or more in the projective plane.

3. The spark plug for use in an internal combustion engine according to claim 1, wherein the noble metal tip is joined such that the center axis of the noble metal tip is displaced 0.1 mm or more from the center axis of the ground electrode toward the base-end side in the axial direction.

4. The spark plug for use in an internal combustion engine according to claim 1, wherein a shortest distance between the inner layer and the noble metal tip is set so as to range from 0.5 mm to 2 mm.

5. The spark plug for use in an internal combustion engine according to claim 1, wherein the noble metal tip is joined to an inner periphery of the ground electrode situated close to a center electrode side while a distal-end face of the noble metal tip protrudes from a distal-end face of the ground electrode.

6. The spark plug for use in an internal combustion engine according to claim 5, wherein a length of a portion of the noble metal tip joined to the ground electrode along the center axis of the ground electrode is set so as to range from 0.5 mm to 1.5 mm.

7. The spark plug for use in an internal combustion engine according to claim 5, wherein a depth to which the noble metal tip is embedded from the internal periphery of the ground electrode is set to 0.1 mm or more.

8. The spark plug for use in an internal combustion engine according to claim 1, wherein a portion of the ground electrode, which is joined to the noble metal tip, is flat.

9. The spark plug for use in an internal combustion engine according to claim 8, wherein the inner periphery of the ground electrode is subjected to cutting or pressing so as to make flat the portion to which the noble metal tip is to be joined.

10. The spark plug for use in an internal combustion engine according to claim 1, wherein the distal-end face of the noble metal tip is arranged so as to oppose the leading end portion of the center electrode; and spark discharge is produced substantially along a direction orthogonal to the axial direction.

11. The spark plug for use in an internal combustion engine according to claim 1, wherein an end face of the noble metal tip in the axial direction is arranged so as to oppose the leading end portion of the center electrode; and spark discharge is produced substantially along the axial direction.

12. The spark plug for use in an internal combustion engine according to claim 1, wherein the end face of the noble metal tip is arranged to oppose the axial line situated on the leading-end side than the center electrode; and spark discharge is produced obliquely with respect to the axial direction.

13. The spark plug for use in an internal combustion engine according to claim 1, wherein the maximum cross-sectional area of the ground electrode achieved within a cross section orthogonal to the center axis of the ground electrode is set to 3.3 $mm^2$ or less.

14. The spark plug for use in an internal combustion engine according to claim 1, wherein a relationship of $0.35 \leq a/A \leq 0.60$ is satisfied where:

"A" is a length of the inner layer within the projective plane along a widthwise direction of the inner layer;

"a" is a length of an overlap area between the inner layer and the noble metal tip within the projective plane along the widthwise direction of the inner layer.

15. The spark plug for use in an internal combustion engine according to claim 1, wherein a relationship of $0.07 \leq b/A \leq 0.40$ is satisfied where:

"A" is a length of the inner layer within the projective plane along a widthwise direction of the inner layer; and "b" is a length of an overlap area between the inner layer and the noble metal tip within the projective plane along a direction perpendicular to the widthwise direction of the inner layer.

* * * * *